US008454252B2

(12) United States Patent
Shiraiwa et al.

(10) Patent No.: US 8,454,252 B2
(45) Date of Patent: Jun. 4, 2013

(54) CASSETTE FOR A PRINTER

(75) Inventors: Yoshinobu Shiraiwa, Machida (JP); Minoru Tanabe, Kawasaki (JP); Kenji Ito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 741 days.

(21) Appl. No.: 11/913,714

(22) PCT Filed: Feb. 15, 2007

(86) PCT No.: PCT/JP2007/053243

§ 371 (c)(1),
(2), (4) Date: Nov. 6, 2007

(87) PCT Pub. No.: WO2007/097383

PCT Pub. Date: Aug. 30, 2007

(65) Prior Publication Data

US 2009/0080959 A1 Mar. 26, 2009

(30) Foreign Application Priority Data

Feb. 20, 2006 (JP) ..... 2006-042535
Feb. 27, 2006 (JP) ..... 2006-050590
Aug. 2, 2006 (JP) ..... 2006-211050

(51) Int. Cl.
*B41J 17/32* (2006.01)
*B65H 1/04* (2006.01)
*B41J 13/03* (2006.01)

(52) U.S. Cl.
CPC . *B41J 17/32* (2013.01); *B41J 13/03* (2013.01); *B65H 1/04* (2013.01)
USPC ..... 400/208; 400/246; 400/624; 347/214

(58) Field of Classification Search
USPC ..... 400/208, 624; 347/214
See application file for complete search history.

(56) References Cited

U.S. PATENT DOCUMENTS 4,647,234 A * 3/1987 Isobe ..... 400/120.01
4,696,590 A * 9/1987 Bierhoff et al. ..... 400/613
4,752,785 A * 6/1988 Isobe ..... 346/136
4,892,425 A 1/1990 Shimizu et al.
4,901,090 A 2/1990 Ozawa et al.
4,914,452 A 4/1990 Fukawa
4,978,240 A * 12/1990 Katsuno ..... 400/224.2
5,079,565 A 1/1992 Shimizu et al.
5,277,502 A 1/1994 Kim
5,451,996 A 9/1995 Awai et al.

(Continued)

FOREIGN PATENT DOCUMENTS

CN 1205275 1/1999
EP 0 466 194 1/1992

(Continued)

*Primary Examiner* — Daniel J Colilla
(74) *Attorney, Agent, or Firm* — Fitzpatrick, Cella, Harper & Scinto

(57) ABSTRACT

An integrated ink-and-paper cassette (1) mountable to a thermal transfer printer (40) includes an ink-sheet supply unit housing (20) between an opening (30) for ejecting the recording sheet (13) and an ink-sheet take-up unit housing (21). Also, an upper case (10) mainly defining a recording sheet housing (22) is welded to a lower case (11) defining ink-sheet housings when assembled with the upper case (10), in the vicinity of a conveyance path of the ink sheet (12) at which a load is likely applied.

5 Claims, 34 Drawing Sheets

U.S. PATENT DOCUMENTS

| | | | | |
|---|---|---|---|---|
| 5,584,587 | A | 12/1996 | Koike et al. | |
| 5,626,334 | A * | 5/1997 | Kondo et al. | 271/121 |
| 5,741,080 | A | 4/1998 | Tomoda et al. | |
| 6,069,642 | A | 5/2000 | Isobe | |
| 6,082,913 | A * | 7/2000 | Yamamoto et al. | 400/208 |
| 6,504,564 | B1 | 1/2003 | Funaki et al. | |
| 7,242,417 | B2 | 7/2007 | Nishitani et al. | |
| 2002/0028101 | A1 * | 3/2002 | Sakuta et al. | 400/207 |
| 2005/0212896 | A1 | 9/2005 | Nishitani et al. | |
| 2007/0195147 | A1 | 8/2007 | Tanabe | |
| 2009/0080959 | A1 | 3/2009 | Shiraiwa et al. | |
| 2009/0087244 | A1 | 4/2009 | Tanabe | |

FOREIGN PATENT DOCUMENTS

| | | | | |
|---|---|---|---|---|
| EP | 0 891 871 | | | 1/1999 |
| EP | 1 580 013 | | | 9/2005 |
| JP | 62-151370 | | | 7/1987 |
| JP | 62-211221 | A | | 7/1987 |
| JP | 62211221 | A | * | 9/1987 |
| JP | 63-197679 | A | | 8/1988 |
| JP | 63-148440 | U | | 9/1988 |
| JP | 63242669 | A | * | 10/1988 |
| JP | 63-197159 | U | | 12/1988 |
| JP | 2-081660 | | | 3/1990 |
| JP | 03173665 | A | * | 7/1991 |
| JP | 04-071882 | A | | 3/1992 |
| JP | 4-122669 | A | | 4/1992 |
| JP | 06-183088 | A | | 7/1994 |
| JP | 8-72348 | A | | 3/1996 |
| JP | 08072348 | A | * | 3/1996 |
| JP | 2523355 | | | 5/1996 |
| JP | 11-078187 | A | | 3/1999 |
| JP | 2000-108442 | | | 4/2000 |
| JP | 2001-205906 | A | | 7/2001 |
| JP | 2002-096516 | A | | 4/2002 |
| JP | 2002273994 | A | * | 9/2002 |
| JP | 2003-029939 | A | | 1/2003 |
| JP | 2003072210 | A | * | 3/2003 |
| JP | 2005-024793 | A | | 1/2005 |
| JP | 2005-306605 | A | | 11/2005 |
| JP | 2005-335292 | A | | 12/2005 |
| JP | 03-173665 | A | | 8/2010 |
| WO | WO 89/08963 | | | 9/1989 |
| WO | WO 2007/097384 | | | 5/2007 |

* cited by examiner

CASSETTE FOR A PRINTER

TECHNICAL FIELD

The present invention relates to a printer that transfers ink applied on an ink sheet to a recording sheet using a thermal head for printing, and a cassette mountable to the printer.

BACKGROUND ART

Typically, printers as Output devices for computers and for digital images may be classified into thermal transfer printers, ink jet printers, laser printers, and so forth, according to recording methods. Thermal transfer printers use an ink sheet and a recording sheet to print images in dotted lines on the recording sheet by selectively driving a plurality of heating elements aligned in a main-scanning direction while conveying the ink sheet and the recording sheet in a sub-scanning direction. In recent years, thermal transfer printers have been gaining popularity as image input devices with the development of digital cameras, digital video cameras, scanners, and the like. Thermal transfer printers are suitable for printing image information captured by an image pickup apparatus such as a digital camera or a digital video camera which records still images, by utilizing a computer or a recording medium.

Ink jet printers use binary printing, namely, whether or not forming dots. Small dots are formed on a recording sheet, and apparent resolution and gradation are provided by error diffusion or other methods. In contrast, thermal transfer printers easily control a heat value for each pixel. Accordingly, each pixel may have wide gradation. Thus, thermal transfer printers are advantageous in the production of smooth and high-quality images compared with other printers such as ink jet printers. In addition, since the performance of thermal heads and the characteristics of recording sheets are excellent, thermal transfer printers can print images having a finishing quality as high as that of pictures obtained by silver salt cameras. Because of this, thermal transfer printers have been gaining popularity particularly as printers for obtaining natural images, in parallel with the development of the digital camera in recent years.

There is also a system that allows printing of image information captured by an image pickup apparatus, by direct communication of a thermal transfer printer with an image pickup apparatus without the use of a computer or a recording medium. Such a system allows the image pickup apparatus to set parameters for printing, and hence, it is possible to print the image information easily, thereby making the thermal transfer printer more attractive to users.

In a thermal transfer method, a plurality of colors of ink are repeatedly transferred to a recording sheet in a case of full-color printing. Typical configurations for the full-color printing will be described below.

A first exemplary configuration of a thermal transfer printer of the related art is shown in FIGS. 32A and 32B. As shown in FIG. 32A, the uppermost one of recording sheets set in a recording sheet cassette 107 is separated and fed by a sheet feed roller 108 and a separating unit 109, and conveyed to a position between a thermal head 104 and a platen roller 105. A printing operation starts with winding the recording sheet P around the platen roller 105. Then, an ink sheet 106 and the recording sheet P are pressed together by the thermal head 104 and the platen roller 105. The platen roller 105 has an outer circumference comparatively larger than the whole length of the recording sheet P. The thermal head 104 generates heat to transfer ink applied on the ink sheet 106 to the recording sheet P while the platen roller 105 is rotated. As shown in FIG. 32B, to print the next color after the first color is printed, the pressure of the thermal head 104 is released, the platen roller 105 is rotated to convey the recording sheet P to a print start position, and the residual colors are printed sequentially in the same manner as that of the first color. The full-color printing is performed with, for example, the three colors of yellow, magenta and cyan.

A second exemplary configuration of a thermal transfer printer of the related art is shown in FIGS. 33A and 33B. As shown in FIG. 33A, the uppermost one of recording sheets set in a sheet cassette 201 is separated and fed by a sheet feed roller 202 and a separating unit 203, and conveyed to a position between a thermal head 204 and a platen roller 205. A printing operation starts with pressing of an ink sheet 206 and a recording sheet P by the thermal head 204 and the platen roller 205. Then, the thermal head 204 generates heat to transfer ink applied on the ink sheet 206 to the recording sheet P while a pair of rollers disposed downstream in a print direction, i.e., a capstan roller 207 and a pinch roller 208, convey the recording sheet P. As shown in FIG. 33B, the next color is printed after the first color is printed. The pressure of the thermal head 204 is released, the capstan roller 207 and the pinch roller 208 are rotated inversely to the printing direction to return the recording sheet P to the print start position, and the residual colors are printed sequentially in the same manner as that of the first color. Full-color printing is again performed with the three colors of yellow, magenta and cyan.

In either one of the examples shown in FIGS. 32A, 32B, 33A and 33B, the recording sheet and the ink sheet in the sheet cassette are consumable supplies, and they are required to be replaced or supplied upon consumption. Generally, an ink sheet is provided to a user in the form of a cartridge in which the ends of the ink sheet are wound around two bobbins, and the bobbins and ink sheet are accommodated in a frame (110 in FIG. 32A or 210 in FIG. 33A). The cartridge has a space 110*a* in FIG. 32A or a space 201*a* in FIG. 33A. When the cartridge is inserted into a printer, the cartridge is guided and mounted in place such that the thermal head 104 or 204 provided in a main body of the printer is accommodated in the space 110*a* or 201*a*.

The above-described two examples are typical printing methods. The first example has a problem in that the size of the printer is increased since a platen roller having an outer circumference comparatively larger than the whole length of the recording sheet P is necessary, and a problem in that the configuration of the printer is complicated since the printer requires a mechanism (not shown in FIGS. 32A and 32B) that winds a recording sheet around the platen roller and holds the recording sheet. Meanwhile, the first example has an advantage of a decrease in print time since a print start portion for the second color is provided directly behind a print end position of the first color, and thus the time required for returning the recording sheet as in the second example is not necessary. In contrast, the second example has a problem in that the print time is increased, but, it has an advantage of miniaturization and simplification of the printer.

The aforementioned thermal transfer printer uses as the recording sheet a special sheet for thermal transfer printing having a surface that allows ink to be easily transferred thereto, for realizing fine printing. Hence, a set product of fifty recording sheets with an ink cartridge accommodating an ink sheet for the fifty recording sheets is commercially available. The user unpacks the recording sheets and the ink cartridge of the purchased set product, and applies the ink cartridge to the main body while applying the recording sheets to the sheet cassette when using the printer. This is labour intensive work.

In the case of a thermal transfer printer, the ink sheet may be effectively used if the ink sheet is prepared so as to be of a size in accordance with the size of the recording sheet as shown in FIG. 34. For example, there are commercially provided a set product of A6 size recording sheets with an ink cartridge accommodating an ink sheet for A6 size, and a set product of A7 size recording sheets with an ink cartridge accommodating an ink sheet for A7 size. The user may purchase either set product according to the purpose. To perform A7 size printing after A6 size printing, the A6 size recording sheets as well as the ink cartridge accommodating the ink sheet for A6 size are removed, and the A7 size recording sheets as well as the ink cartridge accommodating the ink sheet for A7 size are mounted. At this time, the removed A6 size recording sheets and the removed ink cartridge accommodating the ink sheet for A6 size must be stored until they are used. Therefore, since the ink cartridge and the recording sheets are separately provided, and the recording sheets and the ink cartridge should not be exposed to dust and direct sunlight, they must be stored in storage bags or the like. This is also labour intensive work.

To address these drawbacks, there is provided a cartridge in which an ink sheet and recording sheets are provided together in an integrated manner, as disclosed in Japanese Patent Laid-Open Nos. 2-81660 and 2000-108442.

As disclosed in Japanese Patent Laid-Open No. 2-81660, an ink cartridge and a sheet cassette are integrated. However, a printing operation may not be performed while the ink sheet is accommodated in the cartridge. To perform the printing operation, a mechanism that draws the ink sheet from the cartridge and brings the ink sheet to a print position is necessary. The complexity of the printer may be increased and there may be a decrease in reliability due to this mechanism being introduced. The problem of the configuration disclosed in Japanese Patent Laid-Open No. 2-81660 is addressed by a configuration disclosed in Japanese Patent Laid-Open No. 2000-108442. The configuration performs a printing operation without an ink sheet brought to a print position after the integrated cartridge is mounted. Therefore, the user will not face the troublesome work of separately supplying the ink sheet and the recording sheets, or that of separately storing the ink sheet and the recording sheets removed when different sized recording sheets are supplied. However, when photo printing is the primary purpose, a sheet to be used has a predetermined thickness for securing conservation property, durability, and print quality. Owing to this, if such a sheet is strongly bent or the like upon conveyance for printing, a print surface thereof may be damaged or wrinkled. In addition, for example, if such a thick recording sheet is separated from the cassette by separation with pawls, and the sheet may not be reliably separated if a sufficient space for bending the recording sheet is not provided. In Japanese Patent Laid-Open No. 2000-108442, a conveyance path of the sheet is formed with a cassette. The exterior of the cassette has a curved portion with a comparatively large radius so that the sheet will not be strongly bent for preventing damage to the sheet and improving the reliability of the conveyance of the sheet. However, the inside of the curved portion of the cassette for providing the conveyance path is not utilized. In addition, a certain thickness of the cassette is necessary for providing a gently bent conveyance path, and hence, miniaturization is limited. Accordingly, the accommodation of the recording sheets requires a space larger than that necessary for the ink sheet, thereby causing an increase in the size of the main body of the printer.

The present invention provides an integrated ink-and-paper cassette for a compact printer with high usability that may address these problems.

Typically, in dye sublimation printing, which is a thermal transfer printing method, a platen roller and a thermal head are pressed together with an ink sheet and a recording sheet interposed there between in printing. Due to this, the ink sheet is taken up while being strongly pulled in printing. At this time, since the ink-and-paper cassette partly comes into contact with the ink sheet near the ink-sheet conveyance path, the cassette may receive a tension due to the ink sheet, and become bent or deformed if its rigidity is insufficient. Accordingly, conveyance of the ink sheet may be unstable.

Due to production restriction, the integrated ink-and-paper cassette is usually composed of two casings including one for a recording sheet housing and one for an ink-sheet housing, or more than two casings. However, since the cassette involves an eject function for the recording sheet, a plurality of openings are necessary, which may degrade the rigidity of the casings. Further, in procedural steps, two frames are easily coupled if, for instance, the coupling is made using pawls or clips and holes utilizing elastic deformation of resin material. However, it is difficult to maintain the required rigidity of the whole cassette.

The present invention provides an integrated ink-and-paper cassette for a compact printer with high usability. Also, the present invention provides a cassette for a printer that may maintain rigidity and avoid deformation due to a load in printing.

DISCLOSURE OF INVENTION

An object of the present invention is to address at least one of the problems mentioned above.

According to a first aspect of the present invention there is provided a cassette for a printer that transfers ink applied on an ink sheet to a recording sheet by a thermal head for printing, the cassette comprising a first casing defining a recording sheet housing for accommodating recording sheets, a second casing engaging the first casing so as to define a first ink-sheet housing and a second ink-sheet housing, the first ink-sheet housing accommodating a first bobbin around which ink sheet is wound, the second ink-sheet housing accommodating a second bobbin which takes up the ink sheet drawn from the first bobbin, and an opening provided at a surface of the first casing, the surface facing the first and second ink-sheet housings, wherein the first ink-sheet housing is disposed between the second ink-sheet housing and the opening.

According to a second aspect of the present invention there is provided a cassette comprising a recording sheet housing including a substantially rectangular frame having a first opening arranged to allow installation of a recording sheet, and a second opening provided at a surface facing the first opening, for allowing ejection of the recording sheet, an ink-sheet supply unit configured to accommodate an ink sheet to be supplied, and an ink-sheet take-up unit configured to accommodate the ink sheet drawn from the ink-sheet supply unit, wherein the ink-sheet take-up unit is disposed along a first side of the substantially rectangular frame, the second opening is disposed at a second side opposing the first side, and the ink-sheet supply unit is disposed along the second opening.

According to a third aspect of the present invention there is provided a cassette mountable to a printer that transfers ink applied on an ink sheet to a recording sheet by a thermal head for printing, the cassette comprising a first casing defining a recording sheet housing for accommodating the recording sheet, a second casing engaging the first casing so as to define a first ink-sheet housing and a second ink-sheet housing, the first ink-sheet housing accommodating a first bobbin around which the ink sheet is wound, the second ink-sheet housing accommodating a second bobbin which takes up the ink sheet drawn from the first bobbin, and coupling means provided at the first and second casings near a conveyance path of the ink sheet, for coupling the first and second casings.

Further features of the present invention will become apparent from the following description of exemplary embodiments with reference to the attached drawings.

BEST MODE FOR CARRYING OUT THE INVENTION

First Embodiment

A configuration of an integrated ink-and-paper cassette according to an embodiment of the present invention will be described with reference to FIGS. 1 and 2.

Figure 1:
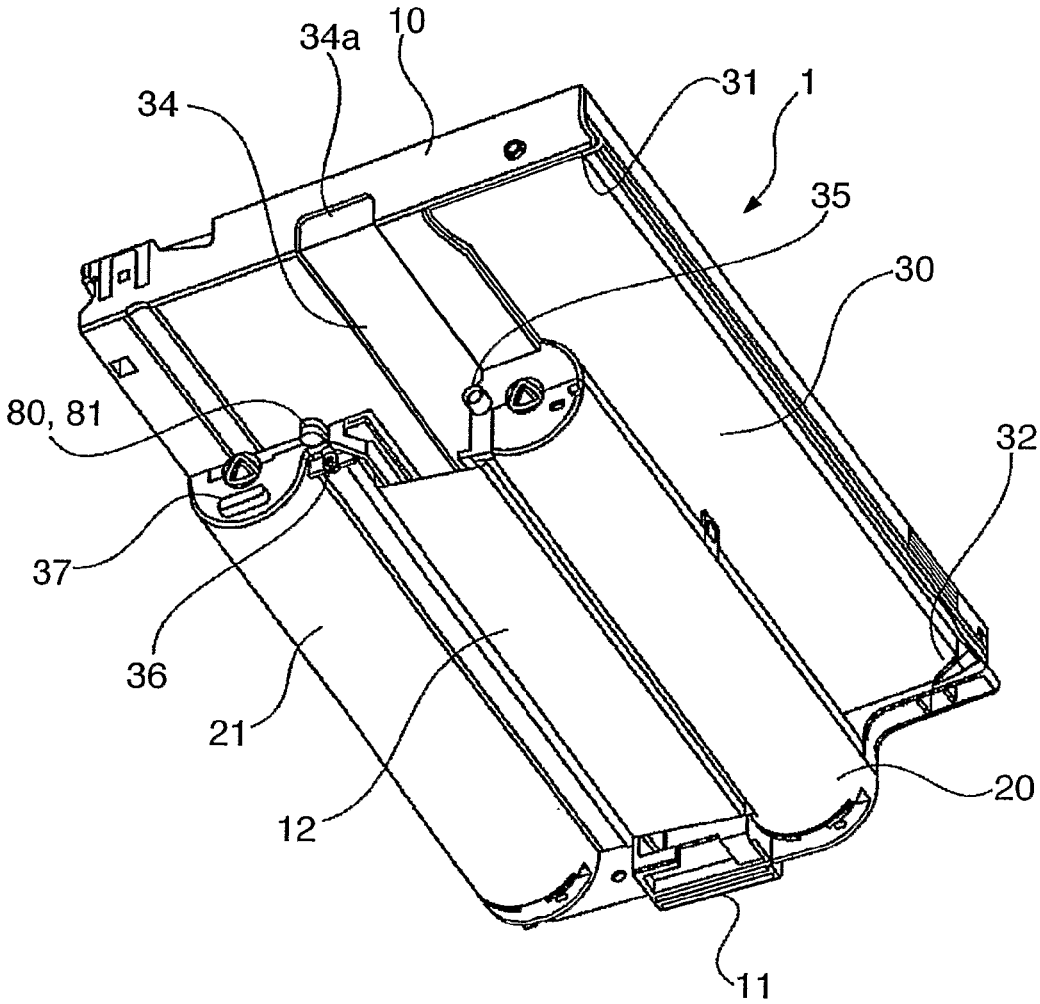
FIG. 1 is a perspective view showing an integrated ink-and-paper cassette according to an embodiment of the present invention.

FIG. 1 is a schematic illustration showing an integrated ink-and-paper cassette 1 according to an embodiment of the present invention. The cassette 1 includes an upper case 10 for mainly accommodating recording sheets, and a lower case 11 for accommodating an ink sheet. The lower case 11 defines ink-sheet housings when it engages the upper case 10. A supply unit housing 20 accommodates an ink sheet before printing, and a take-up unit housing 21 takes up the ink sheet after printing.

An eject portion 30 allows the recording sheets to be ejected one by one. The eject portion 30 is a substantially rectangular opening adjacent to the supply unit housing 20 and disposed at an end of the recording sheet housing over the whole length of the recording sheets. Separation pawls 31 and 32 for separating the recording sheets one by one are disposed at corners of the eject portion 30. The upper and lower cases 10 and 11 are for example made of plastic by injection molding, thereby decreasing the cost.

Figure 2:
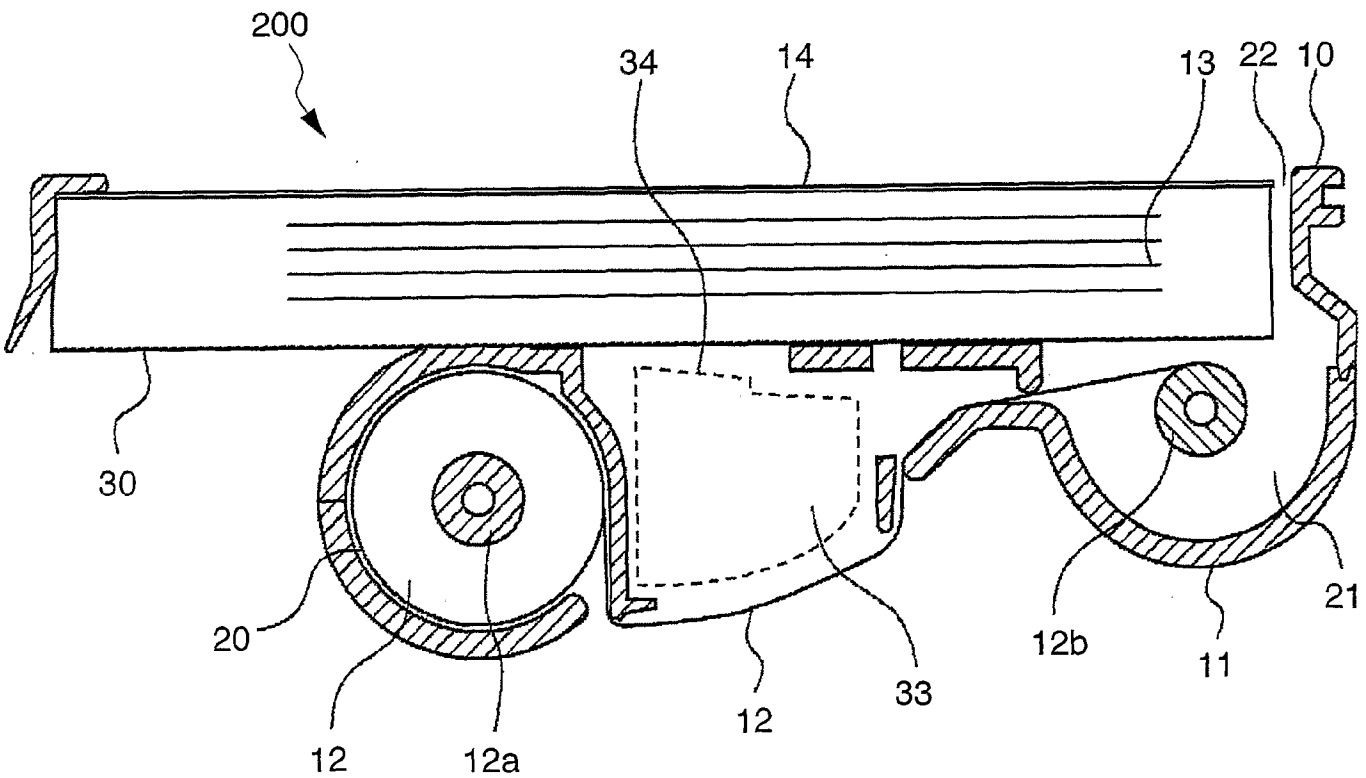
FIG. 2 is a cross sectional view showing the integrated ink-and-paper cassette.

FIG. 2 is a cross sectional view when viewed in a direction orthogonal to a direction of an axis for taking up the ink sheet.

An ink sheet 12 shown in FIG. 2 is a strip form. An end of the ink sheet 12 is attached to a first bobbin 12*a* and the other end is attached to a second bobbin 12*b* for take-up purposes, by bonding or the like. Also the ink sheet 12 is wound around the first bobbin 12*a*. The ink sheet 12, and the first and second bobbins 12*a* and 12*b* are accommodated in the ink-sheet housings defined between the upper and lower cases 10 and 11. The first bobbin 12*a* is accommodated in the supply unit housing 20, and the second bobbin 12*b* is accommodated in the take-up unit housing 21. The first bobbin 12*a* is supported by two end surfaces of the supply unit housing 20 of a cassette casing defined by the upper and lower cases 10 and 11. The second bobbin 12*b* is supported by two end surfaces of the take-up unit housing 21 of the cassette casing.

Recording sheets 13 are accommodated in a recording sheet housing 22 of the upper case 10. The recording sheet housing 22 stacks and accommodates the number of recording sheets printable by using the ink sheet 12 accommodated in the ink-sheet housings. For example, if an ink sheet 12 capable of printing fifty recording sheets 13 is accommodated, fifty recording sheets 13 are accommodated. Namely, with the integrated ink-and-paper cassette 1 according to the embodiment of the present invention, the recording sheets 13 and the ink sheet 12 are used up at the same time when printing for fifty recording sheets 13 is completed. Accordingly, it is avoidable that one of the recording sheets 13 and the ink sheet 12 is used up before the other. Thus, the recording sheets 13 and the ink sheet 12 need not be separately supplied or replaced. Since the recording sheets and the ink sheet are used up at the same time, a user may replace the used cassette 1, and hence, replacement becomes easy.

An upper opening 200 allows the recording sheets 13 and a protection sheet 14 to be set in the recording sheet housing 22. In addition, when a printing operation is performed, pressure is applied to the recording sheets 13 toward a sheet feed roller through the upper opening 200.

The protection sheet 14 prevents the recording sheets 13 from getting dirty or damaged. The contour of the protection sheet 14 is substantially the same as that of the recording sheets 13. The protection sheet 14 is accommodated in the recording sheet housing 22 so as to be stacked on the top of the recording sheets 13. As shown in FIG. 2, a space 33 is defined between the ink sheet 12 and the recording sheets 13. The space 33 is provided for the thermal head unit 45 (described later) when the cassette 1 is mounted to the printer 40. An opening 34 is provided at the upper case 10 between the supply unit housing 20 and the take-up unit housing 21. The opening 34 extends over the whole length of the recording sheet housing 22, and communicates with a lateral opening 34*a* provided at a lateral surface of the upper case 10 as shown in FIG. 1.

In FIG. 1, a first fitting hole 35 is provided at an end surface in the cassette insertion direction of the casing that forms the ink-sheet supply unit housing 20, namely, at a surface in the cassette insertion direction of the cassette casing for supporting the first bobbin 12*a*. A second fitting hole 36 is provided at an end surface in the cassette insertion direction of the casing that forms the take-up unit housing 21, namely, at a surface in the cassette insertion direction of the cassette casing for supporting the second bobbin 12*b*. The first and second fitting holes 35 and 36 are fitted with fitting shafts 56 and 57 (described later) provided at a main body of the printer 40 when the cassette 1 is mounted to the printer 40. Due to the fitting, deformation of the upper and lower cases 10 and 11 in the vicinity of the axis for taking up the ink sheet 12 may be prevented, so that the ink sheet 12 is stabilized when it is conveyed and taken up.

A cassette identification projection 37 has a different shape according to the type of cassette. The shape of the cassette identification projection 37 varies corresponding to the size of recording sheets or the type of ink sheet 12. The main body of the printer 40 identifies the cassette 1 to convey the recording sheet 13 and control printing in accordance with the size of recording sheets 13 or the type of ink sheet 12. Other means of identification can be used, for example an optical or magnetic memory or chip, and a reader mounted in the printer.

Figures 16A, 16B, 16C:
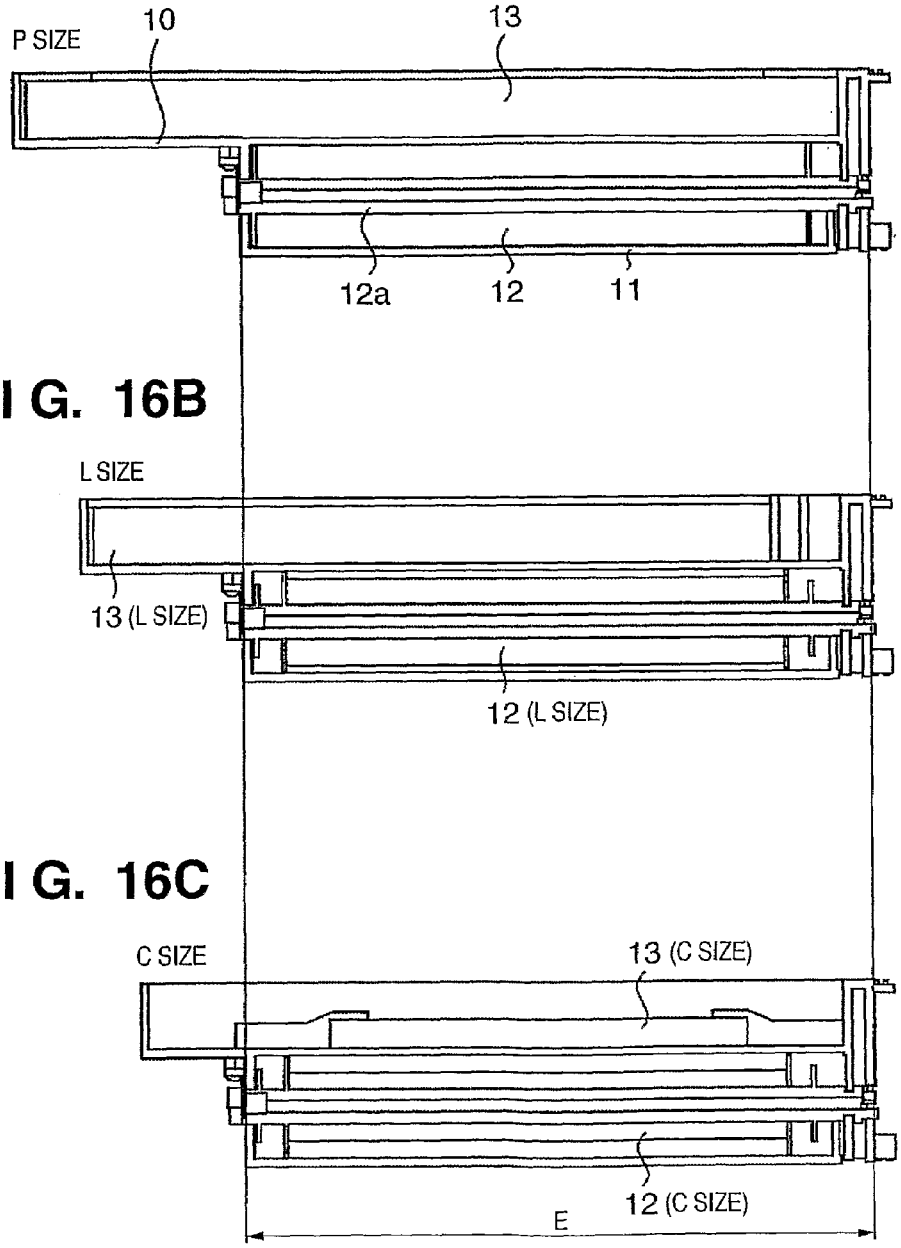
FIGS. 16A to 16C are illustrations showing the three types of integrated ink-and-paper cassettes respectively having different sized recording sheets.

The types of cassettes 1 will be described with reference to FIGS. 15A to 15C, and 16A to 16C. FIGS. 15A to 15C, and 16A to 16C show three types of cassettes 1 varied in size of recording sheets 13, and in particular, these showing cassettes 1 for recording sheets 13 of postcard size, L size, and credit card size, in that order. FIGS. 16A to 16C are cross sectional views taken along the supply unit housing 20 when viewed from the eject portion 30. As shown in FIGS. 15A to 15C, and 16A to 16C, the recording sheet housing 22 of the upper case 10 has the same dimension as that of the ink-sheet housings of the lower case 11 in the direction orthogonal to the axis for taking up the ink sheet 12. The dimension of the recording sheet housing 22 in the direction of the axis for taking up the ink sheet 12 varies depending on the size of recording sheets 13. However, the dimension of the ink-sheet housings in the direction of the axis for taking up the ink sheet 12 is equivalent regardless of the size of recording sheets 13. In addition, as shown in FIGS. 16A to 16C, the width of the ink sheet 12 varies according to the size of recording sheets 13, but the length of the axis for taking up the ink sheet 12 is equivalent regardless of the size of recording sheets 13 similarly to the case of the ink-sheet housings. The above-mentioned first and second fitting holes 35 and 36 are disposed at the end surfaces of the ink-sheet housings. Also, the cassette identification projection 37 is disposed at one end surface of one ink-sheet housing.

Figure 3:
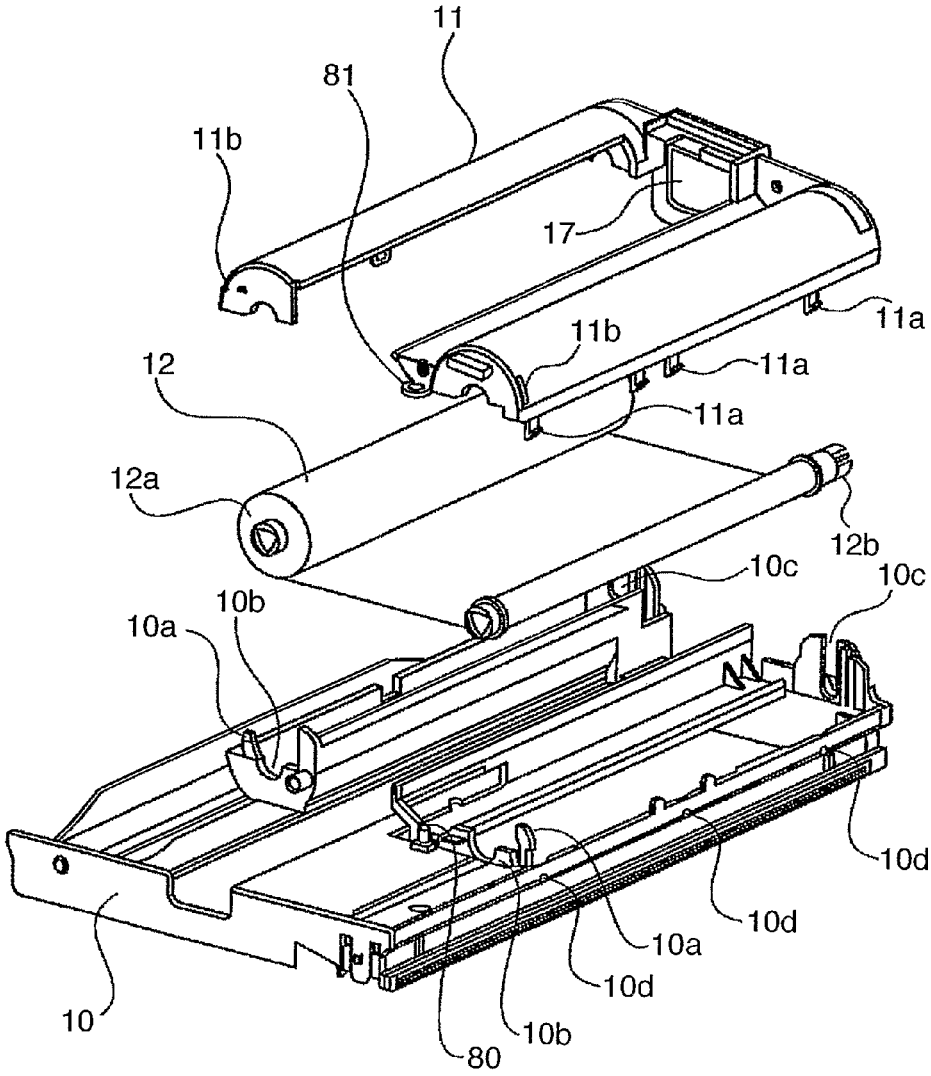
FIG. 3 is an exploded view showing a method of assembling the integrated ink-and-paper cassette.

Next, as shown in FIGS. 3, 4A, 4B, 5 and 6, a method of assembling the integrated ink-and-paper cassette 1 will be described. As shown in FIG. 3, in a state where the recording sheet housing 22 of the upper case 10 is located below, the first and second bobbins 12*a* and 12*b* are disposed at semicircular cut portions 10*b* and U-shaped cut portions 10*c* of the upper case 10, so that the ink sheet 12 is accommodated. Then, the lower case 11 is assembled to the upper case 10 from the above. Pawls or clips 10*a* of the upper case 10 engage holes 11*b* of the lower case 11, and pawls or clips 11*a* of the lower case 11 engage holes 10*d* of the upper case 10, so that the upper case 10 engages the lower case 11. Though not shown, similar pawls and holes are disposed at the backside in FIG. 3, and hence, the primary portion of the lower case 11 is fixed to the upper case 10. In addition, in the integrated ink-and-paper cassette 1 according to the embodiment of the present invention, a weld shaft 80 provided at the upper case 10 is coupled to a weld hole 81 provided at the lower case 11 by heat welding. While the upper and lower cases 10 and 11 are coupled together by heat caulking, these may be coupled by ultrasonic caulking. Alternatively, the upper and lower cases 10 and 11 may be coupled by screwing as long as these are reliably fixed together. In addition, while the upper and lower cases 10 and 11 are coupled by caulking utilizing the shafts and the holes as described above, the coupling may employ any welding or fixing method as long as the upper and lower cases 10 and 11 are reliably fixed.

Figure 4A:
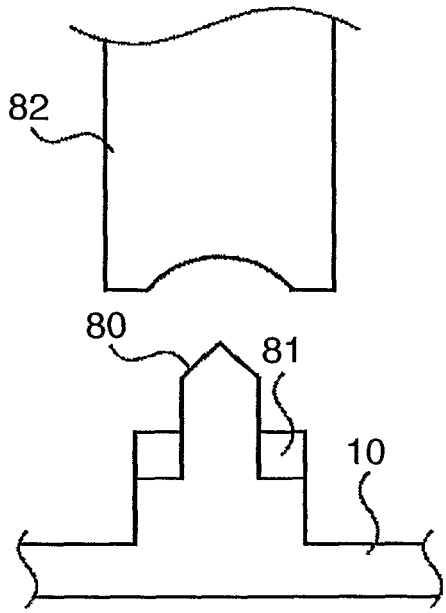
FIGS. 4A and 4B are explanatory views each showing the method of assembling the integrated ink-and-paper cassette.
Figure 4B:
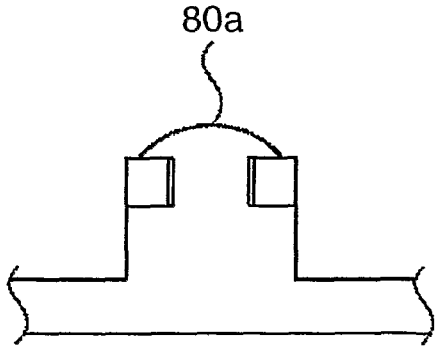

The coupling will be described in more detail with reference to FIGS. 4A and 4B. FIG. 4A shows a state where the ink sheet 12 and the lower case 11 are assembled to the upper case 10 (these components shown in FIG. 3). In this state, the weld shaft 80 of the upper case 10 penetrates through the weld hole 81 of the lower case 11. Holding this state, a terminal 82 of a welding tool presses a tip end of the weld shaft 80 by a predetermined pressure to deform the tip end of the weld shaft 80. Accordingly, as shown in FIG. 4B, the outside diameter of a portion 80*a* of the weld shaft 80 becomes larger than a diameter of the weld hole 81. In addition, since the portion 80*a* is closely attached to the lower case 11 from above in the drawing, the reliable coupling and fixture are realized. As shown in FIG. 4A, the tip end shape of the terminal 82 of the welding tool is a recessed curve (i.e. concave), and the shape of the portion 80*a* of the weld shaft 80 after the deformation is convex. Alternatively, the tip end of the terminal 82 may be flat, and the weld shaft 80 may be deformed to a flat surface. This case may also attain the same advantage. In addition, the terminal 82 may be provided with a heater to generate heat, or the terminal 82 may be oscillated with ultrasonic waves to generate heat. In either case, since the tip end of the weld shaft 80 is tapered (e.g. conic), deformation likely begins at the tip end of the conic portion.

Figure 5:
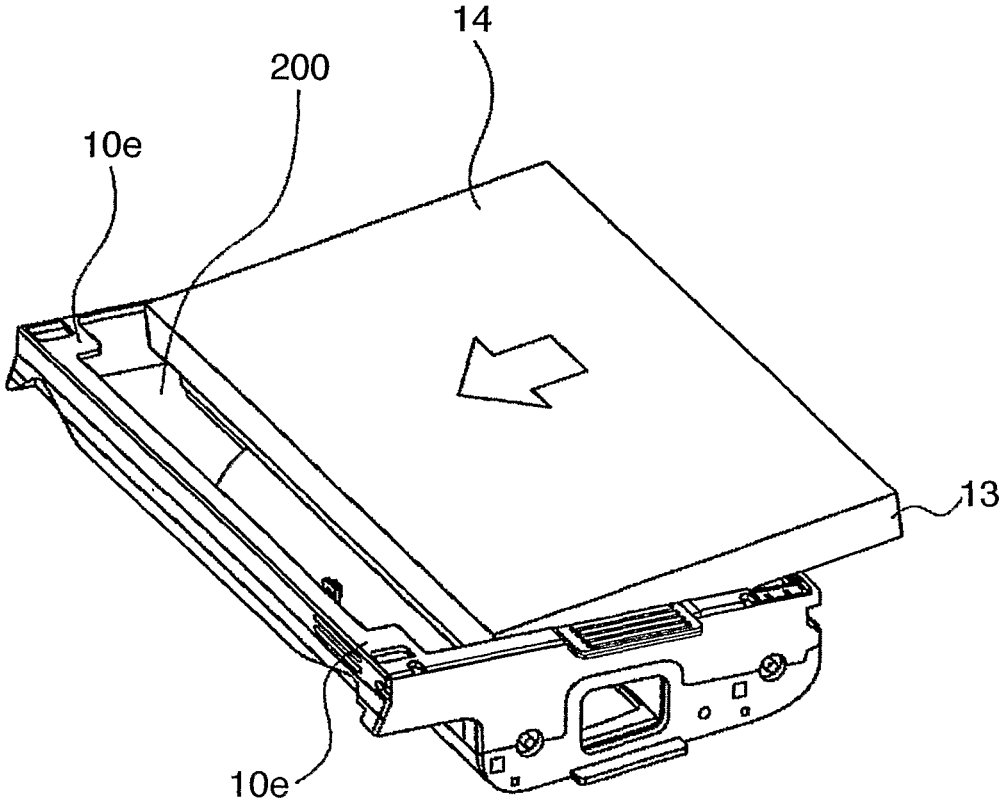
FIG. 5 is an explanatory view showing the method of assembling the integrated ink-and-paper cassette.
Figure 6:
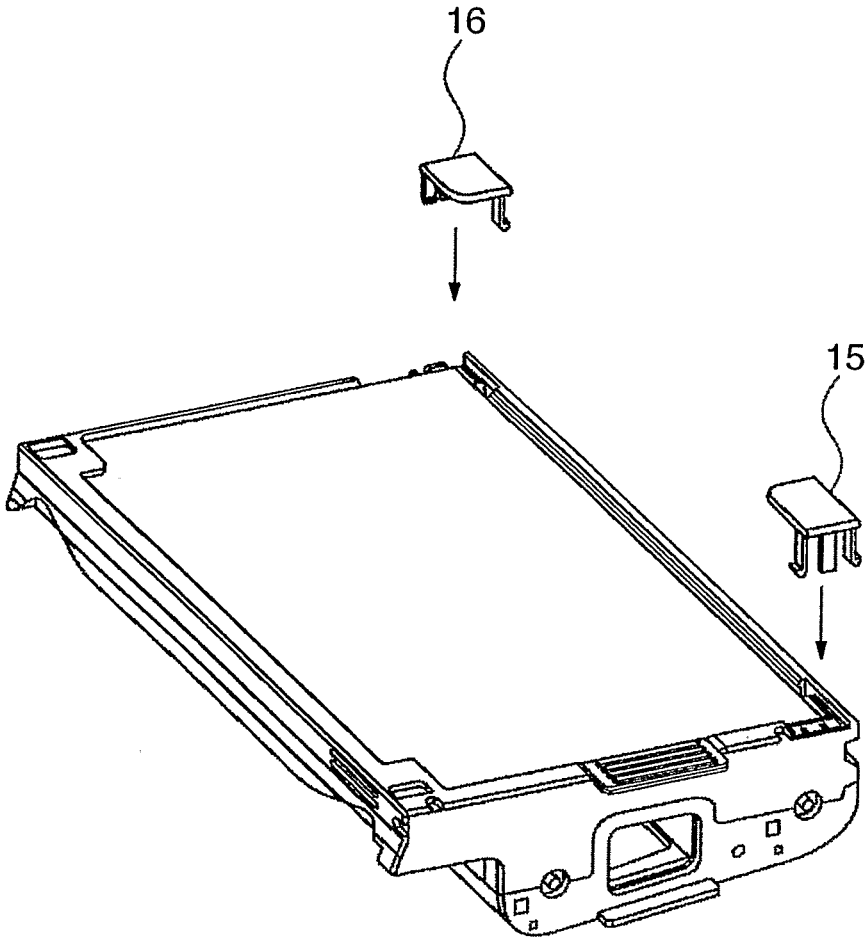
FIG. 6 is an explanatory view showing the method of assembling the integrated ink-and-paper cassette.

Next, installation of the recording sheets 13 and the protection sheet 14 will be described with reference to FIG. 5. After the ink sheet 12, the lower case 11 and the upper case 10 are assembled together, fifty recording sheets 13 and one protection sheet 14 are stacked, and the stacked sheets are installed to the upper case 10 obliquely from the upper opening 200 toward the backsides of two pressing members 10*e* provided at corners. At this time, the recording sheets 13 will not fall from the eject portion 30 since the two separation pawls 31 and 32 are provided at corners. After the recording sheets 13 and the protection sheet 14 are installed to the upper case 10, pressing members 15 and 16 are attached to the residual two corners not provided with the pressing members 10*e*. Accordingly, the four corners of the recording sheets 13 are held, and the recording sheets 13 are accommodated in the recording sheet housing 22 without falling there from. The pressing members 15 and 16 are made of resin, and attached to the upper case 10 using fixing means such as pawls or clips utilizing elastic deformation of the resin. The above-described integrated ink-and-paper cassette 1 according to the embodiment of the present invention mainly includes the two components, the upper and lower cases 10 and 11 to accommodate the recording sheet and the ink sheet. This makes numerous other components unnecessary, thereby downsizing the cassette 1.

Figure 7:
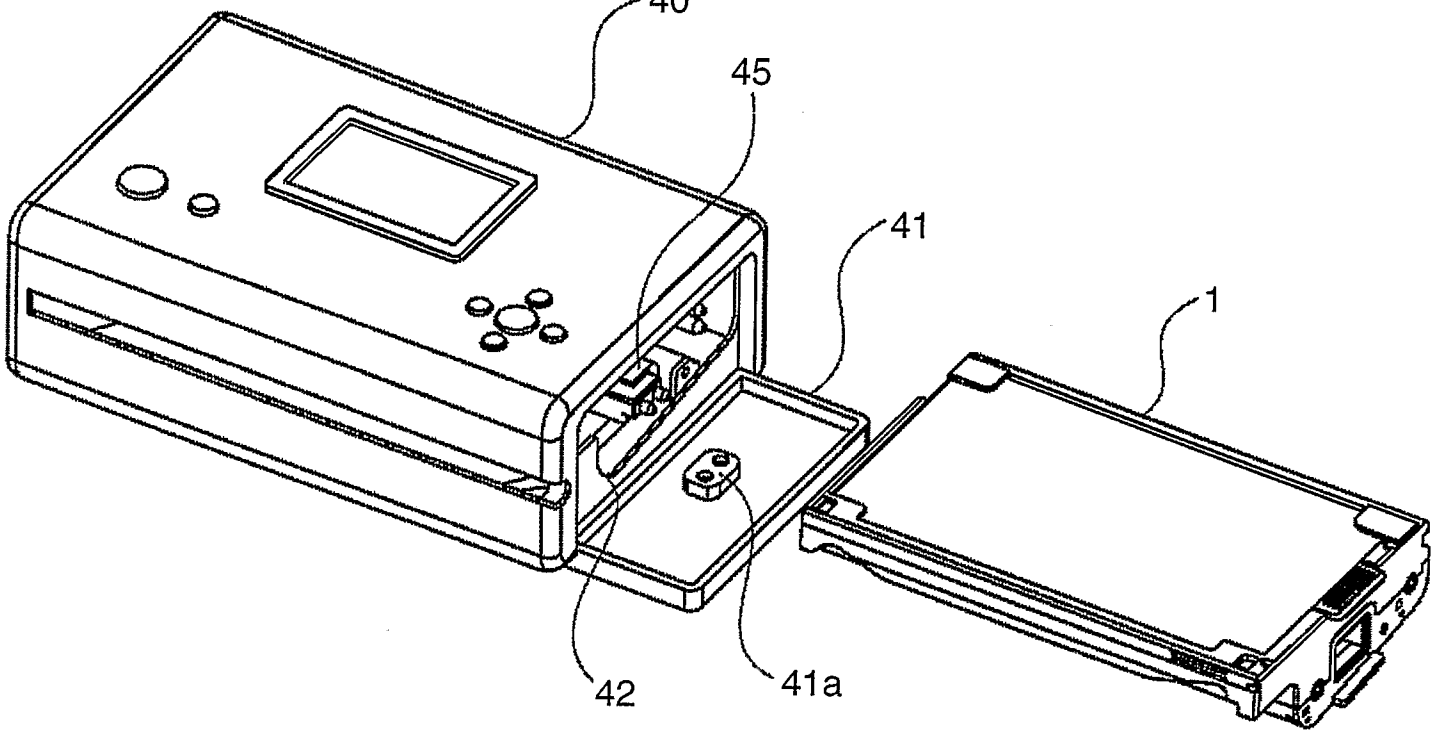
FIG. 7 is an explanatory view showing a printer using the integrated ink-and-paper cassette.
Figure 8:
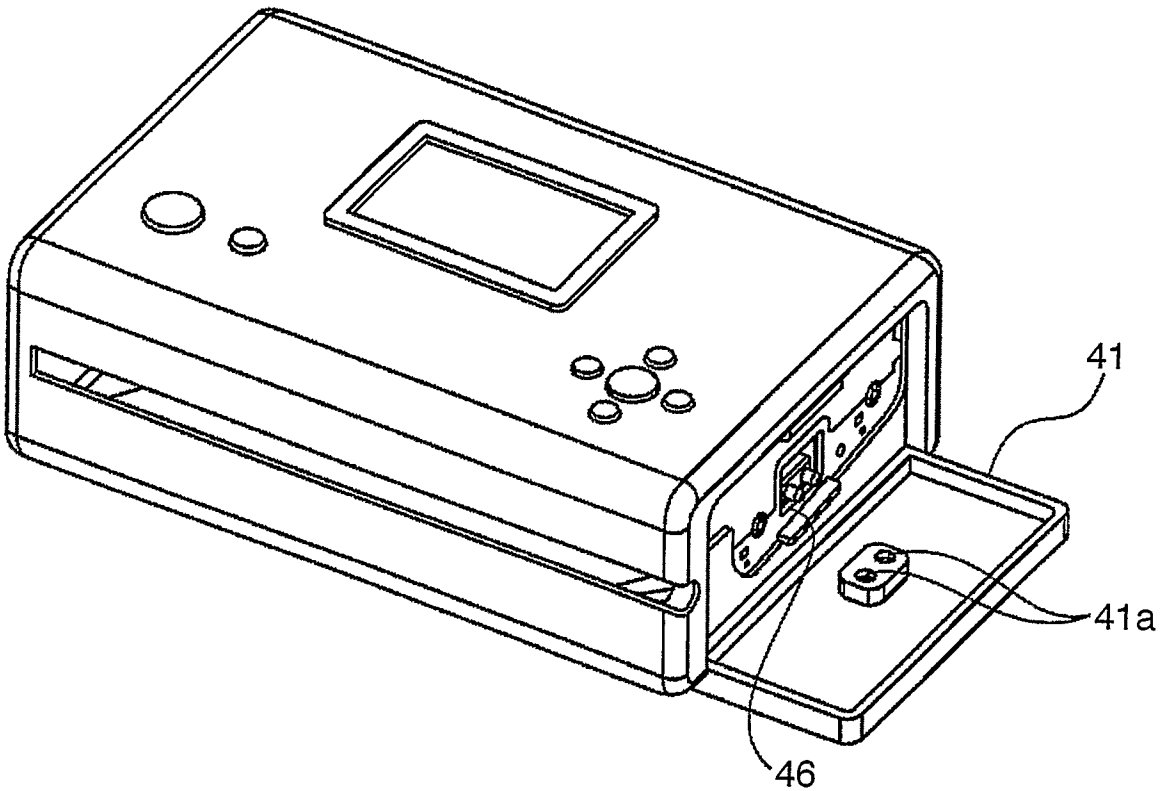
FIG. 8 is a perspective view showing the printer using the integrated ink-and-paper cassette.

Next, a printer 40 using the integrated ink-and-paper cassette 1 according to the present invention will be described with reference to FIG. 7. FIG. 7 shows a main body of the printer 40 with a door 41 provided at a lateral surface being open and a cassette insertion port 42 exposed. The cassette insertion port 42 has a shape similar to the cross sectional shape of the cassette 1, but the size thereof is slightly larger than that of the cross section of the cassette 1. An end of the thermal head unit 45 is exposed through the cassette insertion port 42. FIG. 8 shows a state where the cassette 1 is completely inserted into the cassette insertion port 42. As shown in FIG. 8, when the cassette 1 is completely inserted into the main body of the printer 40, the end of the thermal head unit 45 is partly exposed through an opening 17 of the cassette 1 and a shafts 46 provided at the end of the thermal head unit 45 protrude from the cassette 1 by a predetermined amount. In this state, when the door 41 is closed, engagement holes 41*a* fit with shafts 46 provided at the inner surface of the door 41, and a position of the end of the thermal head unit 45 is regulated, so that the printer 40 becomes ready for use.

Figure 9:
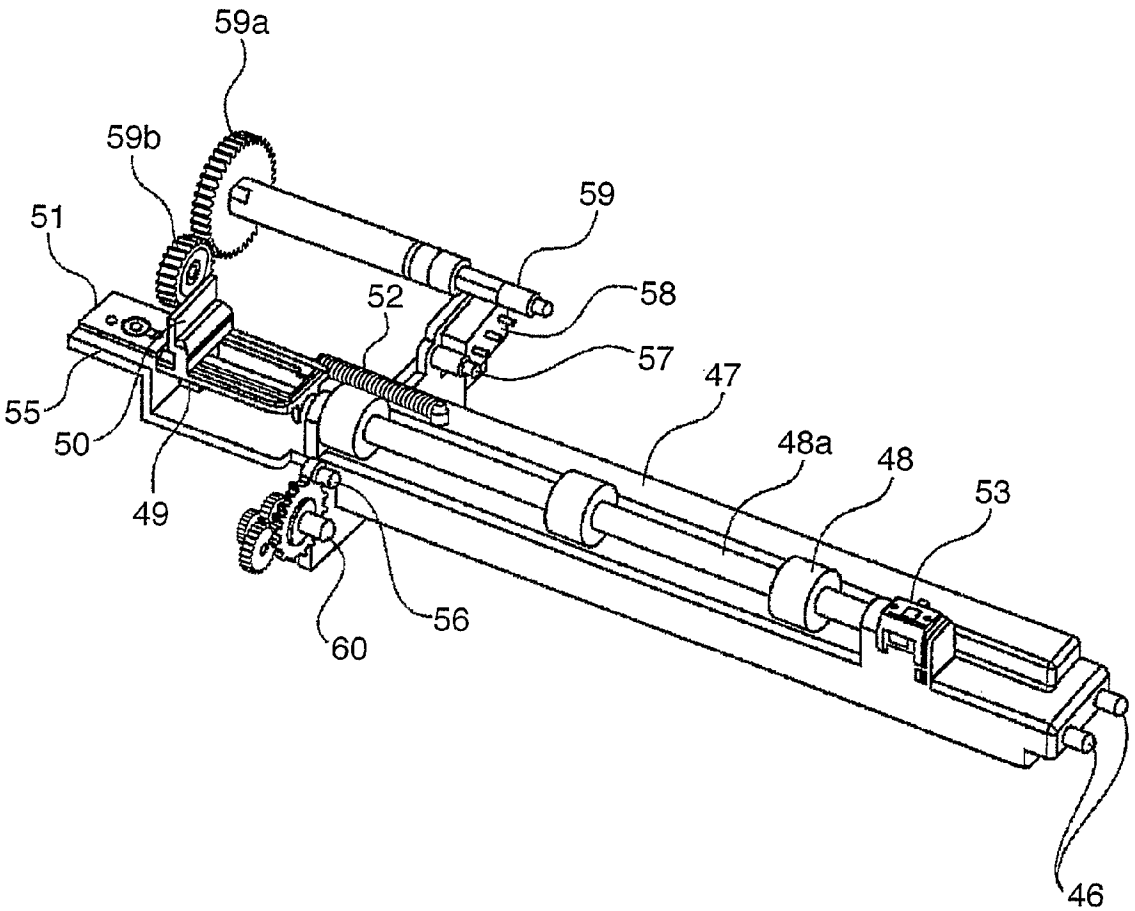
FIG. 9 is a perspective view showing a thermal head unit 45 of the printer using the integrated ink-and-paper cassette.

FIG. 9 shows the thermal head unit 45 of the printer 40 using the integrated ink-and-paper cassette 1 according to the embodiment of the present invention.

A thermal head 47 is electrically connected to a print control board provided in the main body of the printer 40. A sheet feed roller 48 has a shaft 48*a*. Both ends of the shaft 48*a* are supported so that the sheet feed roller 48 can rotate at the thermal head unit 45. A gear 49 is mounted to one end of the shaft 48*a* to rotate integrally with the shaft 48*a*, and drives the sheet feed roller 48 to rotate via an interlocked gear (not shown).

A biasing member 50 biases the recording sheet 13 provided in the cassette 1 rightward in the drawing. The biasing member 50 has a contact surface 50*a* (shown in FIG. 18) fitted to the shaft 48*a* and the other end that is held by a rail 51 fixed at a head frame 55 slidably in the cassette insertion direction. The biasing member 50 is biased against the cassette insertion direction by spring 52.

Figure 10:
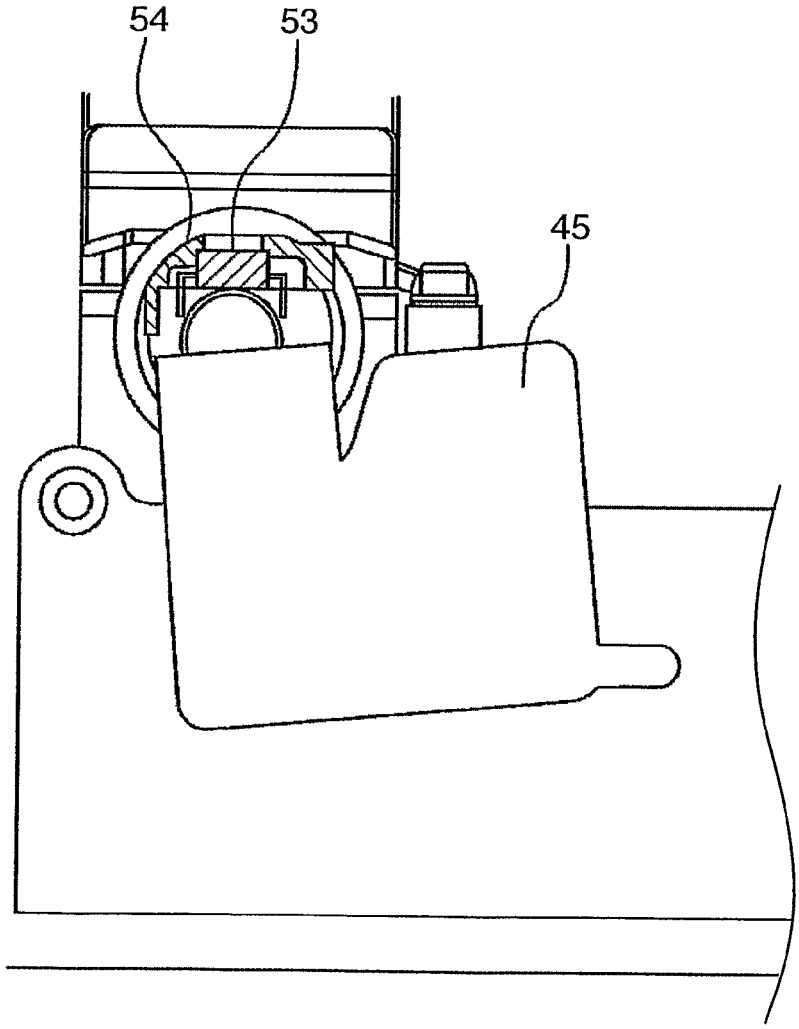
FIG. 10 is a cross sectional view with a photo reflector 53 attached.

The photo reflector 53 detects the presence of the recording sheets 13 provided in the cassette 1. The photo reflector 53 is attached to the thermal head unit 45 by a holder 54. FIG. 10 is a cross sectional view with the photo reflector 53 mounted. As shown in FIG. 10, a light emitting and receiving portion of the photo reflector 53 is attached to the thermal head unit 45 to face upward, and the holder 54 is provided from above.

First and second fitting shafts 56 and 57 prevent deformation of the cassette 1 when the cassette 1 is mounted to the main body of the printer 40. When the cassette 1 is mounted, the first and second fitting shafts 56 and 57 fit in the first and second fitting holes 35 and 36 to regulate the position of the cassette 1 in the main body of the printer 40.

A cassette identification switch 58 identifies the type of cassette 1. When the cassette 1 is mounted to the main body of the printer 40, the cassette identification switch 58 identifies the type of cassette 1 according to the shape of projection provided at the cassette 1.

A winding shaft 59 engages the second bobbin 12*b* when the cassette 1 is mounted to the main body of the printer 40, to drive winding of the ink sheet 12 in printing. The winding shaft 59 is coupled to gears 59*a* and 59*b* so as to rotate at a predetermined rate in the printing operation. A driven shaft 60 is rotated when the ink sheet 12 is wound. For instance, the driven shaft 60 detects the rotation operation of the ink sheet 12 and determines whether or not the ink sheet 12 is fed reliably.

Figure 11:
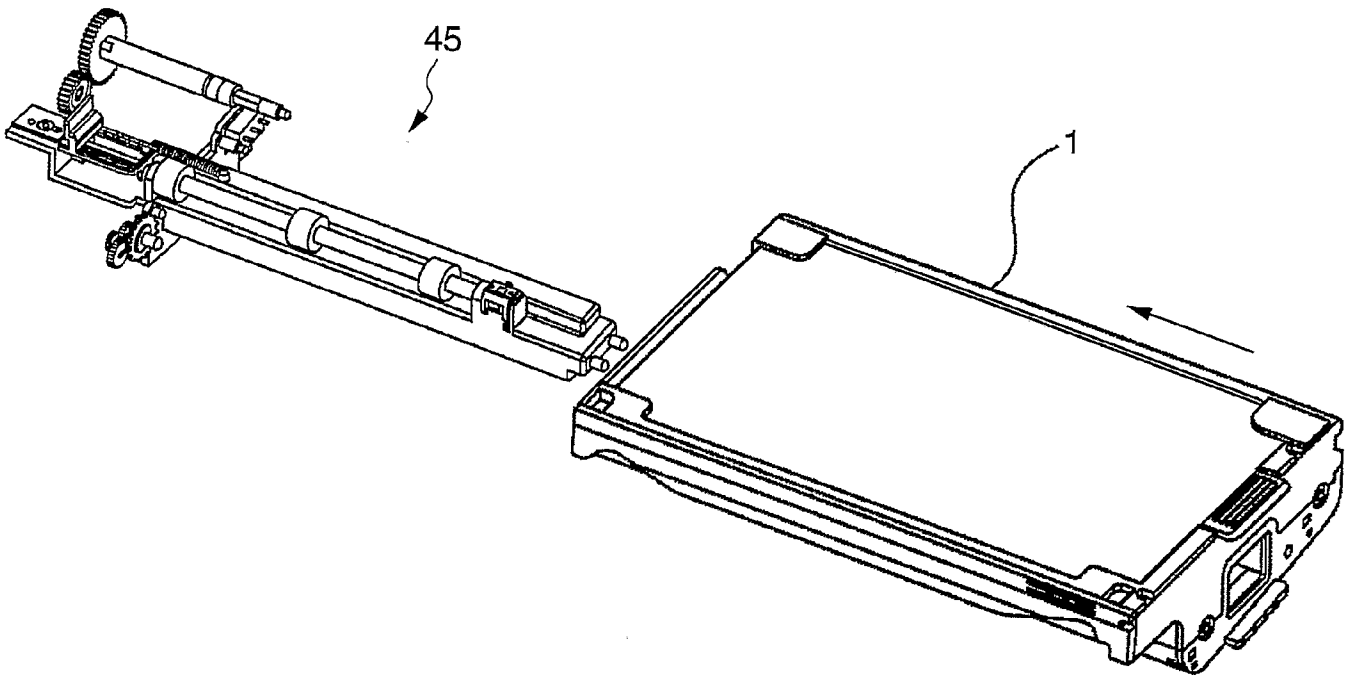
FIG. 11 is an illustration showing the middle of the process of mounting the cassette 1 with respect to the thermal head unit 45.

The above-described thermal head unit 45 is disposed in the main body of the printer 40. Now, mounting steps of the cassette 1 with respect to the thermal head unit 45 will be described with reference to FIGS. 11 to 13. The cassette 1 is inserted to the printer 40 in the direction indicated by the arrow in FIG. 11, and mounted to the printer 40. At this time, the thermal head unit 45 is installed to the space 33 provided between the recording sheets 13 in housing 22 and the ink sheet 12 exposed between the ink-sheet supply unit housing 20 and the ink-sheet take-up unit housing 21 as shown in FIG. 2.

Figure 12:
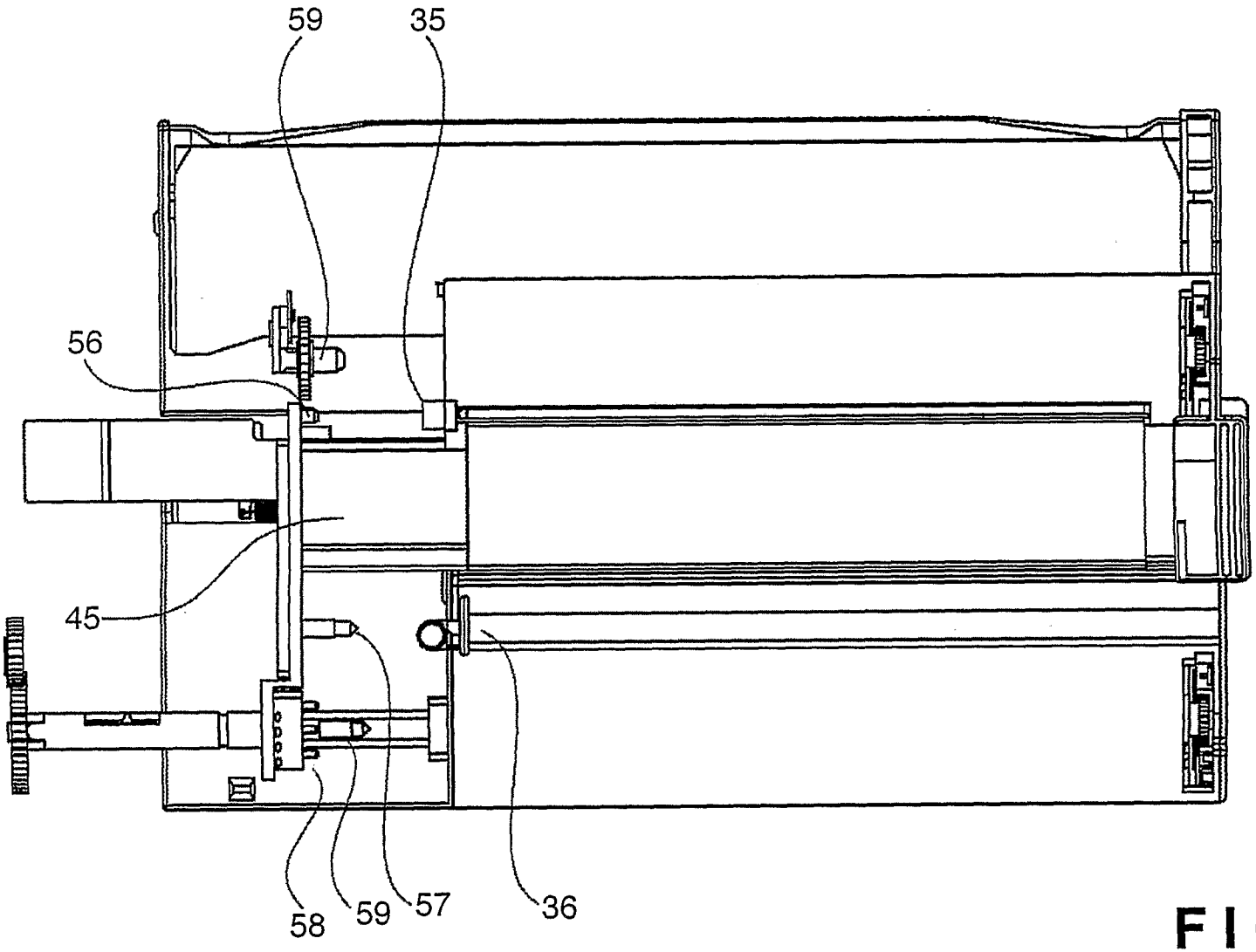
FIG. 12 is an illustration showing the middle of the process of mounting the cassette 1 with respect to the thermal head unit 45.
Figure 13:
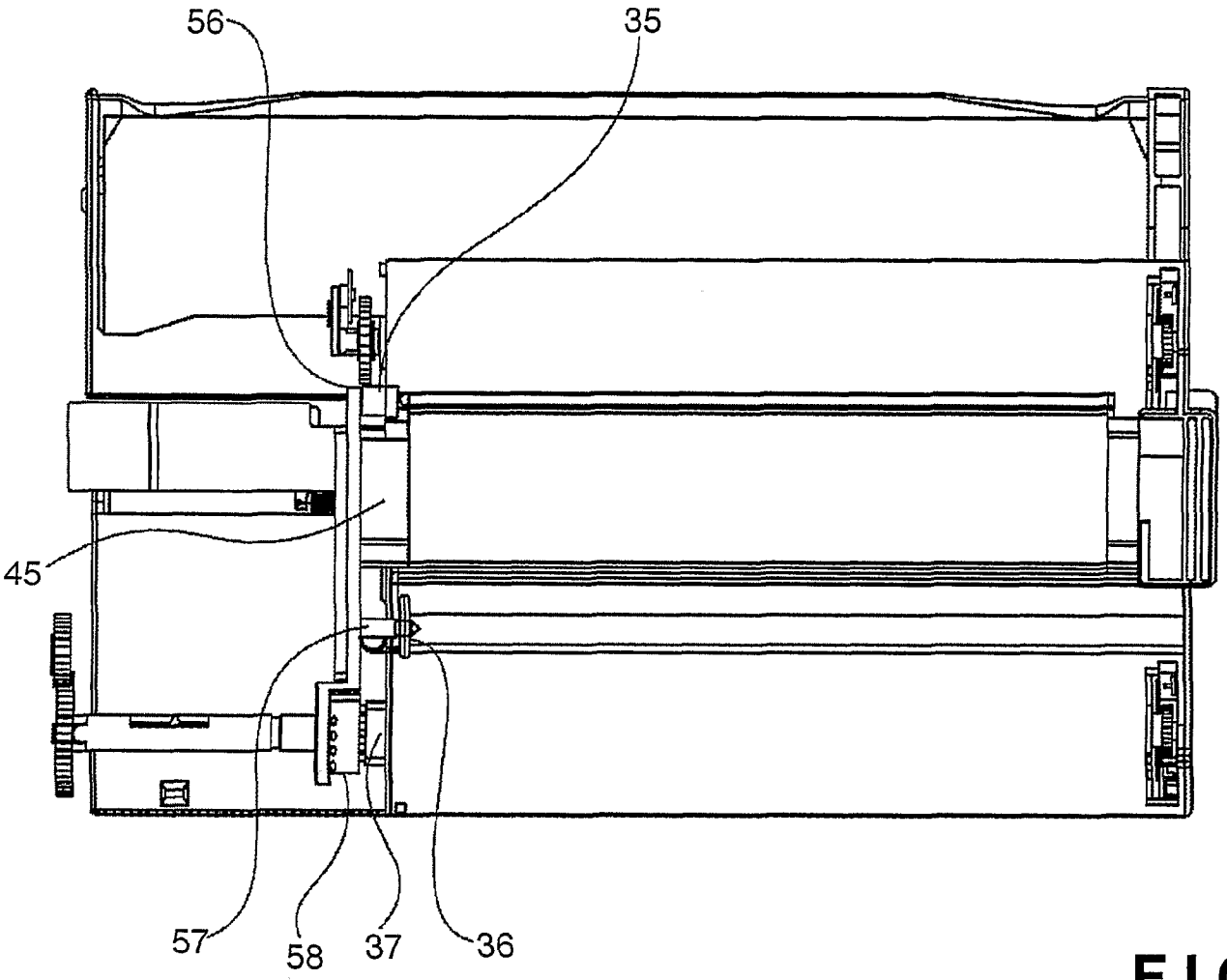
FIG. 13 is an illustration showing the cassette 1 completely mounted to a printer 40 in relation to the thermal head unit 45.
Figure 14:
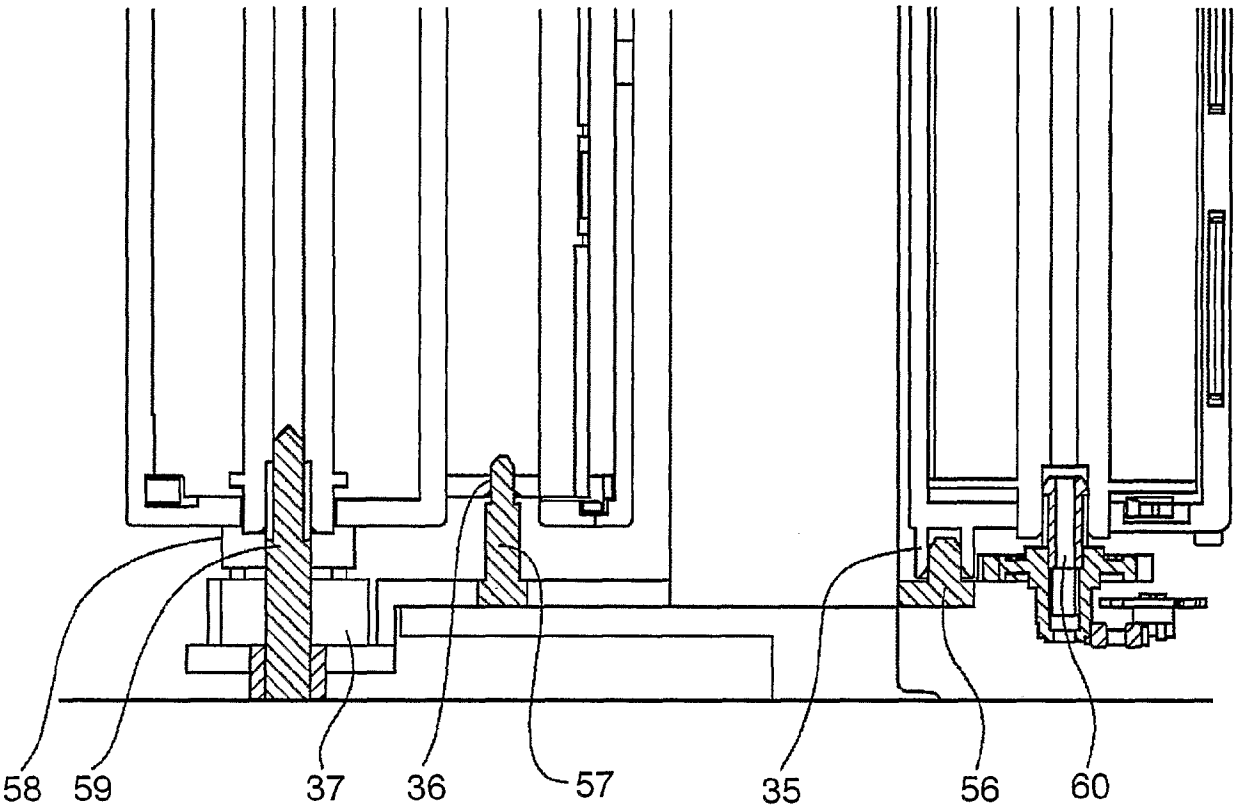
FIG. 14 is another illustration showing the cassette 1 completely mounted to the printer 40 in relation to the thermal head unit 45.
Figure 15A:
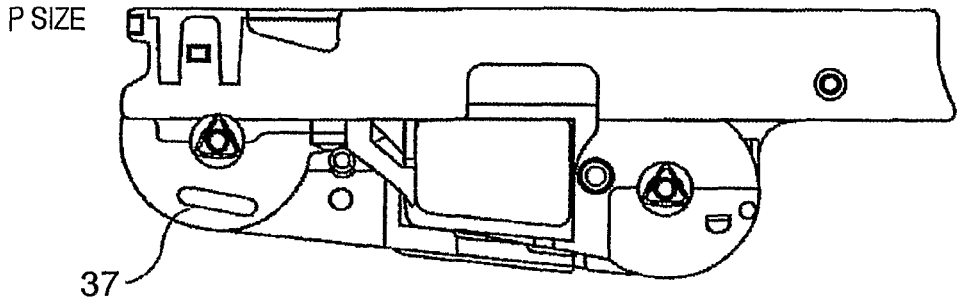
FIGS. 15A to 15C are illustrations showing three types of integrated ink-and-paper cassettes respectively having different sized recording sheets.
Figure 15B:
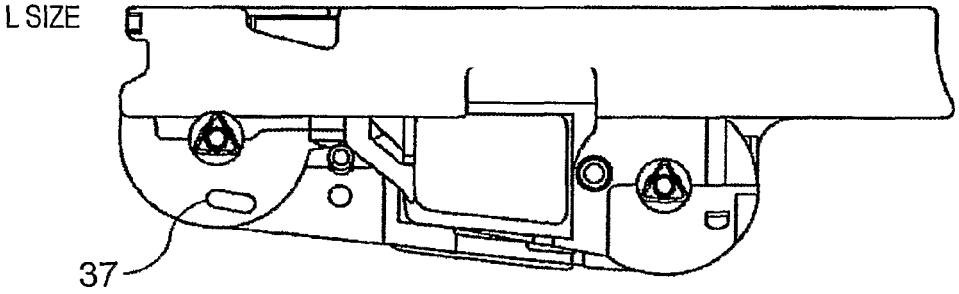
Figure 15C:
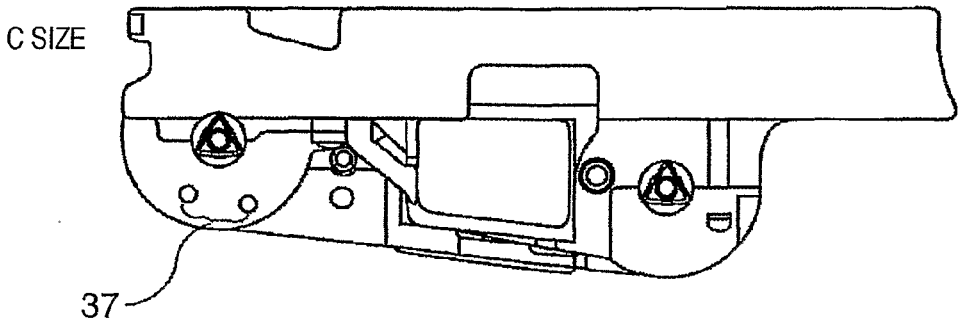

FIG. 12 shows the mounting state when viewed from the backside of the cassette 1. As shown in FIG. 12, the thermal head unit 45 is installed to the space 33 which is above the ink sheet 12 and below the recording sheets 13 in housing 22. FIG. 13 shows the state where the cassette 1 is completely mounted. FIG. 14 is a cross sectional view showing the details of the mounted state. In FIGS. 13 and 14, the first fitting shaft 56 fits in the first fitting hole 35, and the second fitting shaft 57 fits in the second fitting hole 36. Also, the winding shaft 59 fits to the second bobbin 12*b*, and the driven shaft 60 fits to the first bobbin 12*a*. Further, the cassette identification switch 58 is pressed by the cassette identification projection 37.

The first and second fitting holes 35 and 36, and the cassette identification projection 37 are provided at the end surfaces of the ink-sheet housings that have the uniform dimension regardless of the size of recording sheets 13. Due to this, a variety of sets of the first and second fitting shafts 56 and 57, and the cassette identification switch 58 are not required to be provided at the main body of the printer 40 according to the size of sheets. In addition, since the whole lengths of the first and second bobbins 12*a* and 12*b* are equivalent, the whole lengths and the positions of the winding shaft 59 and the driven shaft 60 are not required to be varied. Therefore, even if the cassettes 1 involve various sizes of recording sheets 13, or various sizes of ink sheets 12, the cassettes 1 have the ink-sheet housings with the standardized contour, and the first and second fitting holes 35 and 36, and the cassette identification projection 37 are disposed at one side of the ink-sheet housings. Further, the whole lengths of the first and second bobbins 12*a* and 12*b* are the same. Accordingly, the inner configuration of the main body of the printer 40 may be simplified.

Figure 17:
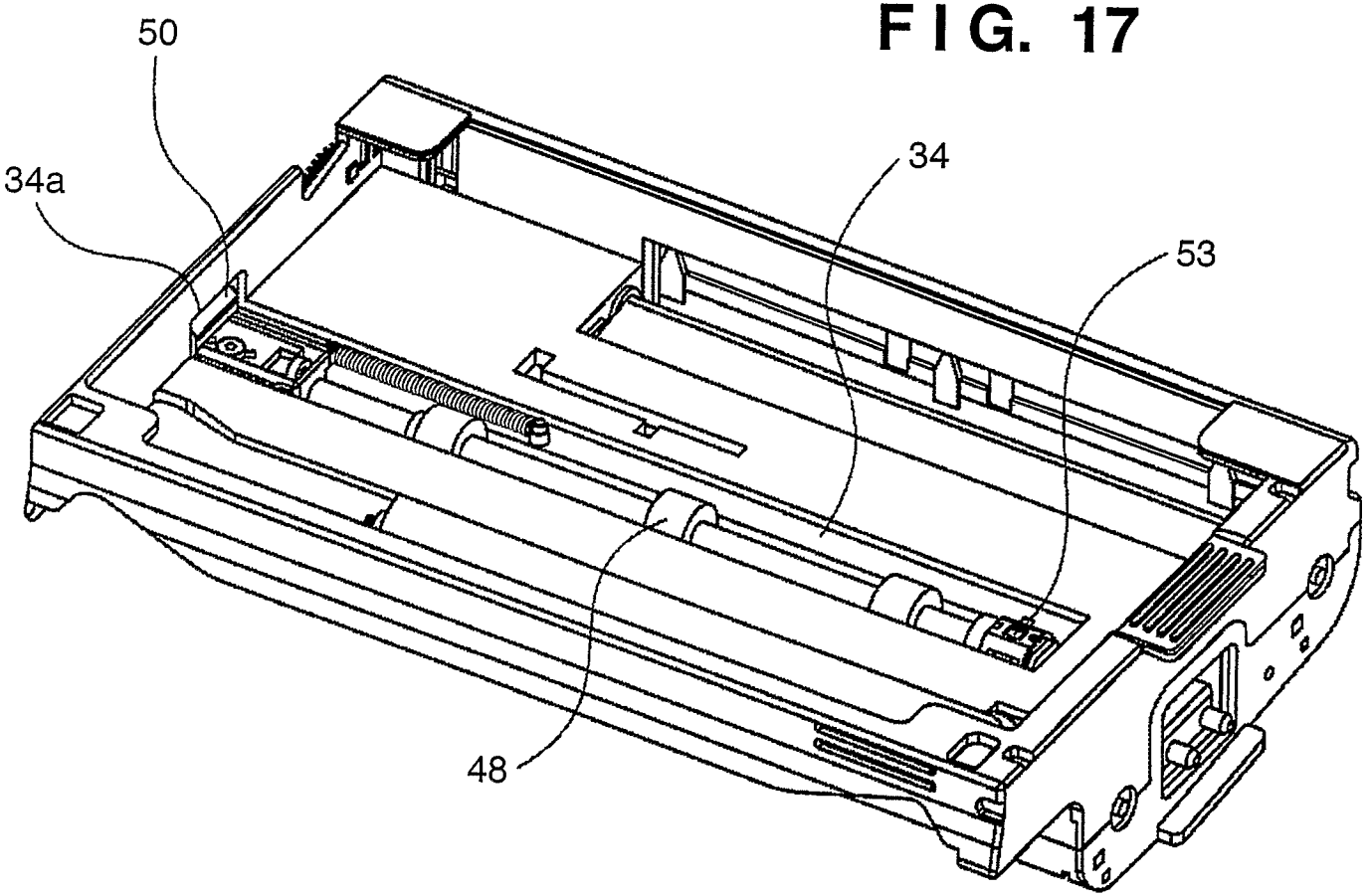
FIG. 17 is a perspective view showing the printer 40 having the cassette 1 mounted thereto with recording sheets 13 and a protection sheet eliminated.

FIG. 17 shows the state where the cassette 1 is completely mounted to the printer 40, with the recording sheets 13 and the protection sheet 14 eliminated for easy understanding. As shown in FIG. 17, the sheet feed roller 48 and the photo reflector 53 are arranged in the opening 34 of the upper case 10. The biasing member 50 is located in the lateral opening 34*a*.

Figure 18:
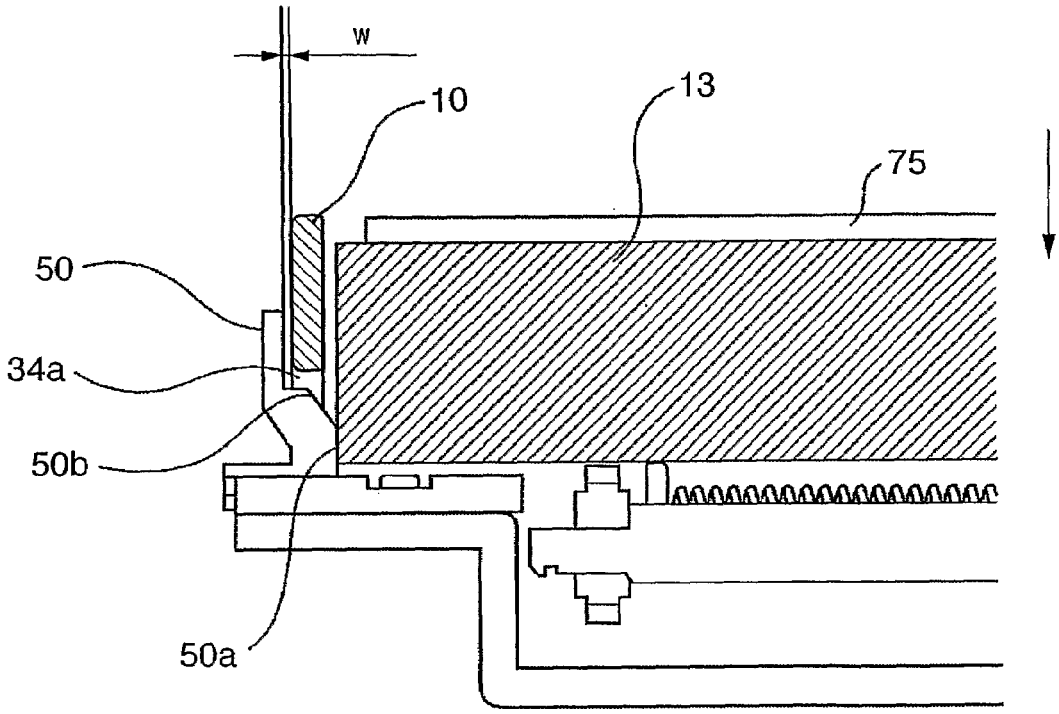
FIG. 18 is a cross sectional view showing a positional relationship of a biasing member 50, the cassette 1, and the recording sheets 13.

FIG. 18 is a cross sectional view showing a positional relationship of the biasing member 50, the cassette 1, and the recording sheets 13. In FIG. 18, the biasing member 50 is biased rightward in the drawing by the spring 52 as already described. The contact surface 50*a* protrudes toward the inside of the upper case 10 from the lateral opening 34*a* and comes into contact with edges of the recording sheets 13. At this time, since a clearance is provided between the recording sheets 13 and an outer lateral surface of the upper case 10, the recording sheets 13 reliably move rightward in the drawing, i.e., they move aside in the direction opposite to the cassette insertion direction. An oblique surface 50*b* provided at the biasing member 50 guides the recording sheets 13 smoothly to the contact surface 50*a* when the recording sheets 13 are pressed by a pressure plate 75 and move in the direction indicated by the arrow in the drawing. In this manner, the recording sheets 13 beside the contact surface 50*a* are fed one by one.

Next, the action of the biasing member 50 will be described.

Figure 20A:
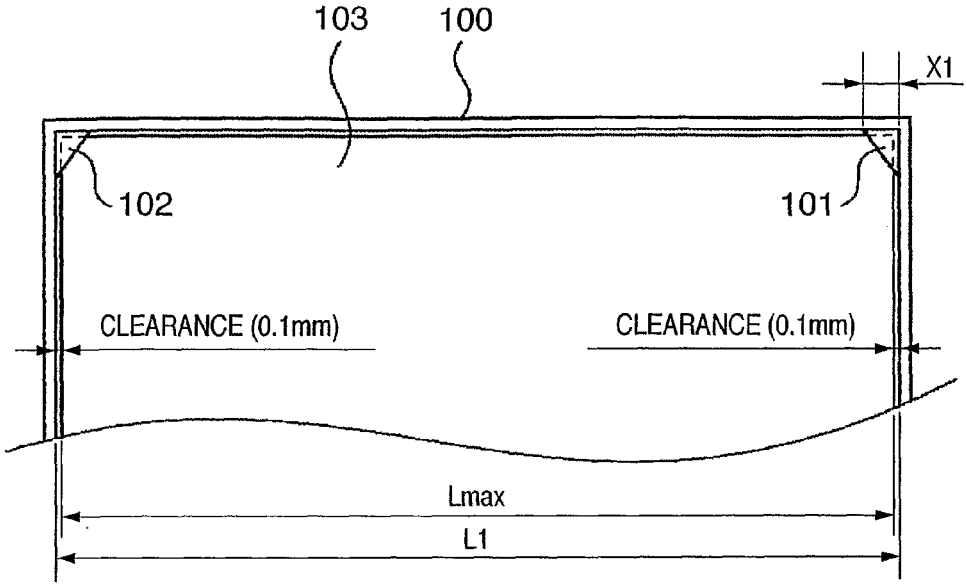
FIGS. 20A and 20B are illustrations each showing a relationship between separation pawls and the recording sheets in a case where the biasing member 50 is not employed.
Figure 20B:
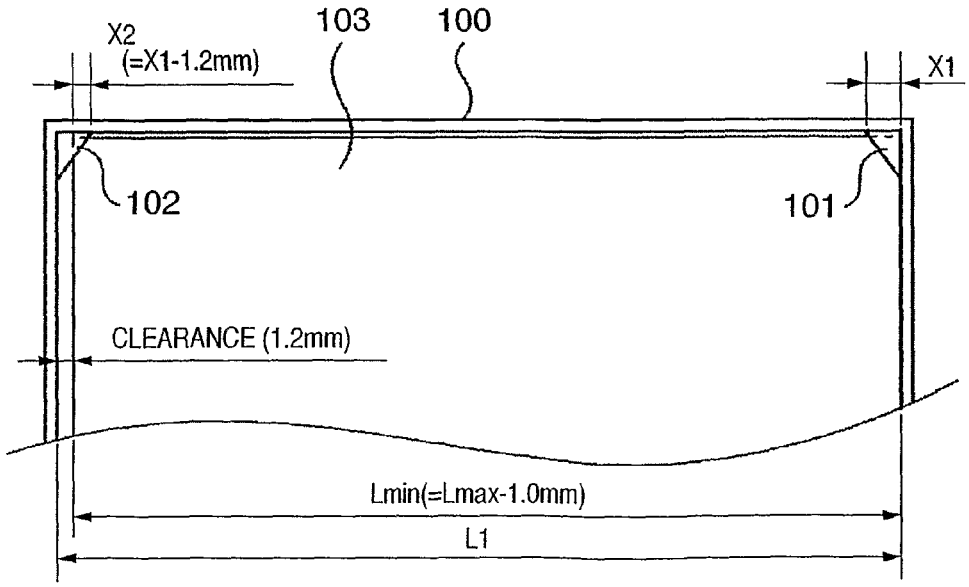

FIGS. 20A and 20B are schematic illustrations for easy understanding each showing a relationship between separation pawls and recording sheets in a case where the biasing member 50 is not employed. In FIG. 20A, the numerical reference 100 is an upper case, and 101 and 102 are separation pawls. Recording sheets 103 are hooked by the separation pawls 101 and 102 at leading corners in the eject direction. In general, recording sheets have tolerances for the length and width due to cutting error of the recording sheets. Thus, an inner dimension L1 of a recording sheet housing of the upper case 100 is necessary to have a clearance with respect to recording sheets having a length of a tolerance upper limit (Lmax). Accordingly, in a case where recording sheets have a length L of a tolerance lower limit, the clearance becomes large. FIG. 20B shows a case of the recording sheets having the length L of the tolerance lower limit (Lmin) which has been moved to the right in the drawing within the upper case 100. In such a case, a hook amount X1 of the recording sheets 103 to the right separation pawl 101 becomes largely different from a hook amount X2 of the recording sheets 103 to the left separation pawl 102. For example, as shown in FIG. 20B, when the tolerance of the length L is ±0.5 mm, the difference between the recording sheets having the tolerance upper limit (Lmax) and these having the tolerance lower limit (Lmin) is 1.0 mm. In addition, if a clearance of 0.1 mm is provided at each side of the recording sheets with respect to the inner dimension L1 of the upper case 100, a clearance becomes 1.2 mm in the case of recording sheets having the tolerance lower limit (Lmin). Accordingly, the difference between the hook amount X1 to the separation pawl 101 and the hook amount X2 to the separation pawl 102 is 1.2 mm.

If the hook amounts of the recording sheets to the separation pawls are large enough to ignore such a difference of the hook amounts, the difference will not be serious problem. However, in a case of using recording sheets with the size and paper quality for printing photos, such large separation pawls may not be used in view of loads for separation, and damage to the recording sheets. Accordingly, it is difficult to use large separation pawls to counteract the difference of 1.2 mm. If such separation pawls are used, the difference of separation timings is increased at pawl separation for the recording sheets, and in the worst case, the recording sheet may not be separated.

Figure 19A:
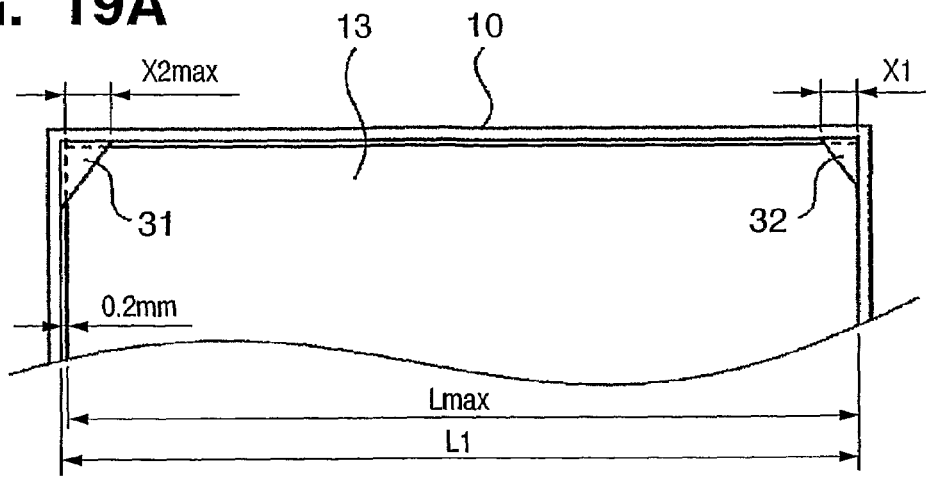
FIGS. 19A to 19C are illustrations each showing a relationship between separation pawls and the recording sheets in a case where the biasing member 50 is employed.
Figure 19B:
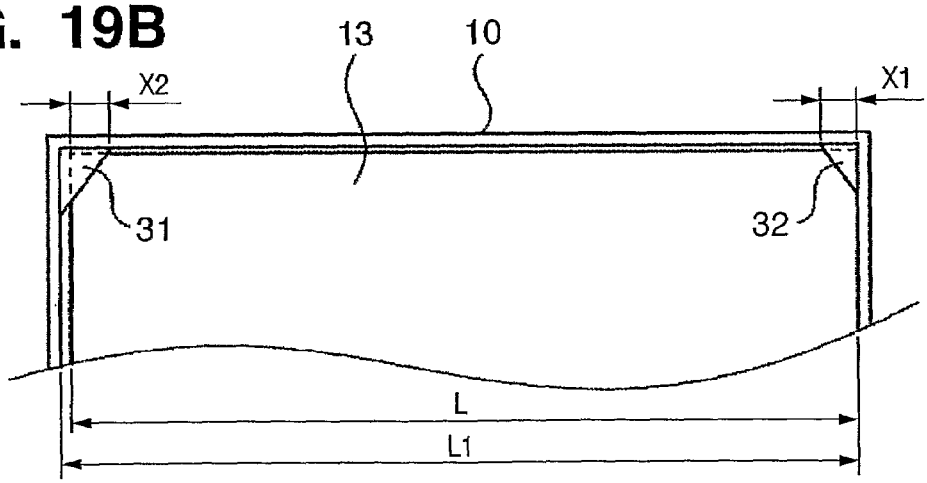
Figure 19C:
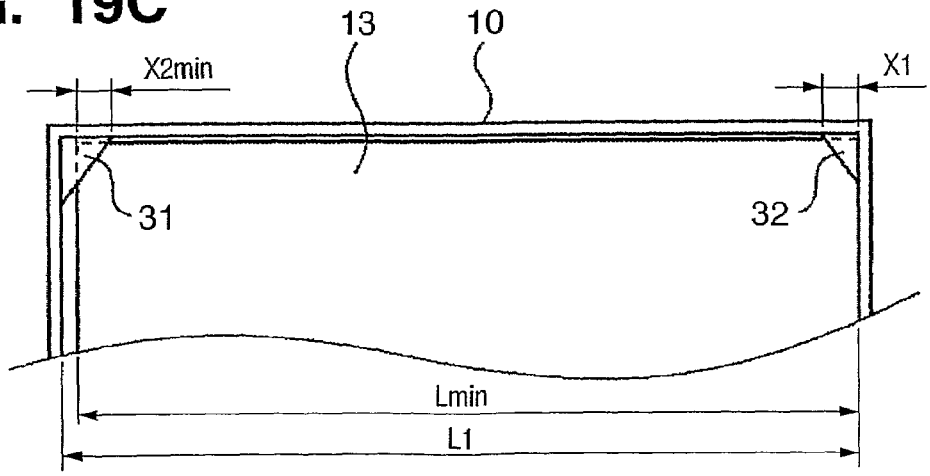

Next, the cassette 1 according to the embodiment of the present invention with the biasing member 50 applied will be described with reference to FIGS. 19A to 19C. These figures are also simplified for easy understanding. FIGS. 19A to 19C are viewed from the eject portion 30 of the cassette 1, and show a relationship between the recording sheets 13 and the separation pawls 31 and 32. FIG. 19A shows a case where a length L of the recording sheets 13 is the tolerance upper limit (Lmax). In this case, the dimension L1 of the recording sheet housing 22 is determined to be wide enough for accommodating the recording sheets 13 even if the length L of the recording sheets 13 is the tolerance upper limit. In this embodiment, the dimension L1 is determined to have a clearance of 0.2 mm at each side as shown in FIG. 19A in the case where the recording sheets 13 has the length L of the tolerance upper limit.

FIG. 19B shows a case where the length L of the recording sheets 13 is equal to the nominal dimension. FIG. 19C shows a case where the length L of the recording sheets 13 is the tolerance lower limit (Lmin). In any of FIGS. 19A to 19C, the leftward direction indicates the cassette insertion direction and the rightward direction indicates the cassette removing direction. Accordingly, the biasing member 50 biases the recording sheets 13 from left to right, so that the recording sheets 13 come into contact with the right inner wall of the upper case 10.

To equalize the hook amounts X1 and X2 of the recording sheets 13 with respect to the separation pawls 31 and 32 when the length L of the recording sheets 13 is the nominal dimension as shown in FIG. 19B, the sizes of the separation pawls 31 and 32 are determined such that the separation pawl 31 becomes larger than the separation pawl 32. With the sizes of the separation pawls 31 and 32 determined in this way, since the recording sheets 13 are moved toward the separation pawl 32 by the biasing member 50, the difference between the hook amounts X1 and X2 when the length L varies within the tolerance range becomes equal to or less than the tolerance of the length L.

When the length L of the recording sheets 13 is the tolerance upper limit (Lmax) as shown in FIG. 19A, the hook amount X2max to the separation pawl 31 is larger than the hook amount X1 to the separation pawl 32 by the amount of tolerance of the length L of the recording sheets 13. For example, when the tolerance of the length is ±0.5 mm, the hook amount X2max is larger than the hook amount X1 by 0.5 mm.

On the other hand, in a case where the length L is the tolerance lower limit (Lmin), the hook amount X2min to the separation pawl 31 is smaller than the hook amount X1 to the separation pawl 32 by the amount of tolerance of the length L of the recording sheets 13. Accordingly, the hook amount X2min is smaller than the hook amount X1 by 0.5 mm.

Accordingly, when the biasing member 50 is not employed, the difference between the hook amounts to the separation pawls result in 1.2 mm at the left and right sides. However, when the biasing member 50 is employed for the cassette 1, the difference of the hook amounts may be restricted to 0.5 mm, which corresponds to the dimensional tolerance of the recording sheets 13. Thus, the difference of the hook amounts to the left and right separation pawls may be minimized, and the difference between the separation timings in separating the recording sheet 13 may be reduced, thereby preventing occurrence of problems, such as failure in separation.

It should be noted that the numerical values of the dimension of the cassette 1 is merely an example, and the values are not limited thereto. The dimension may be determined in accordance with the printer to which the cassette is mounted.

Figure 21:
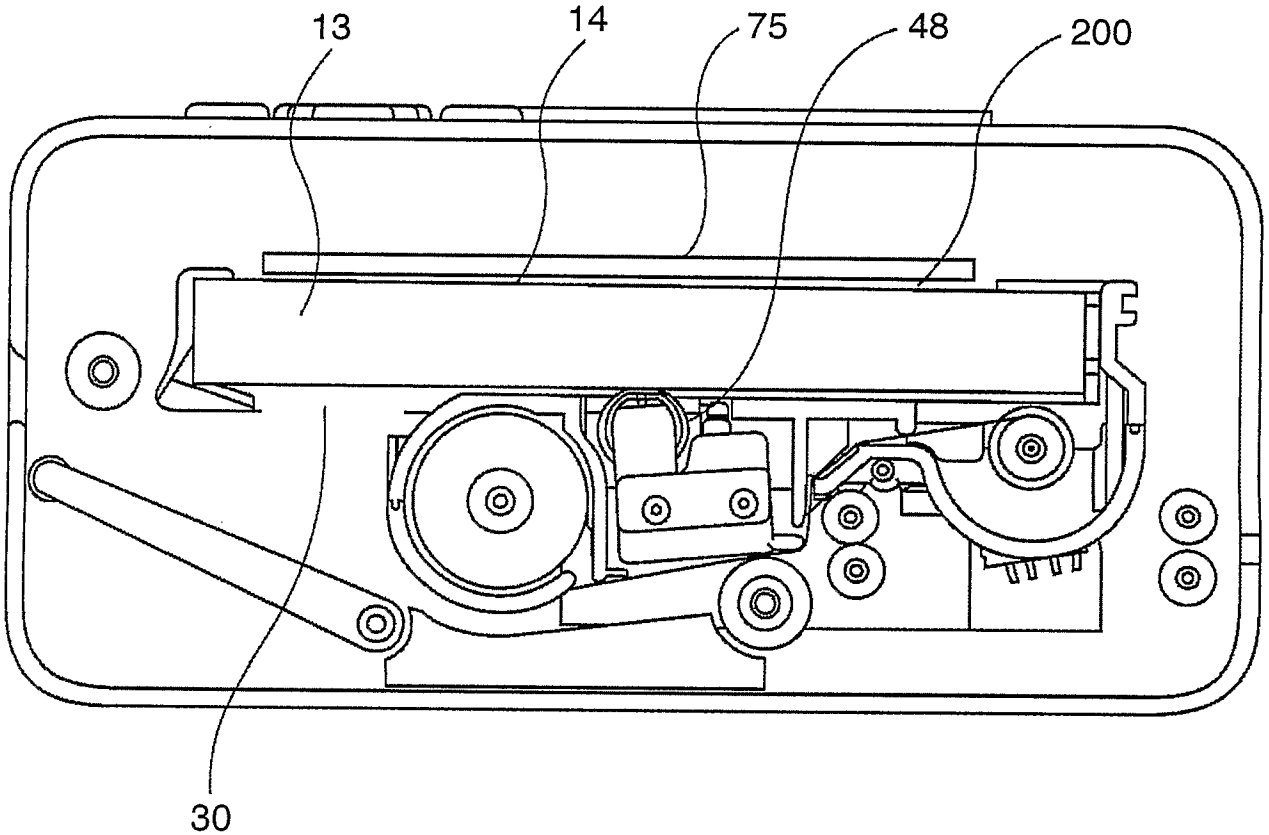
FIG. 21 is an illustration showing an operation of the printer 40.

Next, operation of the printer 40 will be described with reference to FIGS. 21 to 27. FIG. 21 shows a standby position before printing with the cassette 1 mounted to the printer 40. The pressure plate 75 presses the recording sheets 13 toward the sheet feed roller 48 in sheet feeding. Since FIG. 21 shows the standby position, the pressure plate 75 is spaced from the recording sheets 13. In this state, the pressure plate 75 moves downward in the drawing, and presses the recording sheets 13 by a predetermined pressure through the upper opening 200. When the sheet feed roller 48 rotates counterclockwise, one of the recording sheets 13 contacting with the sheet feed roller 48 moves leftward in the drawing, is separated with pawls, and it is ejected from the eject portion 30.

Figure 22:
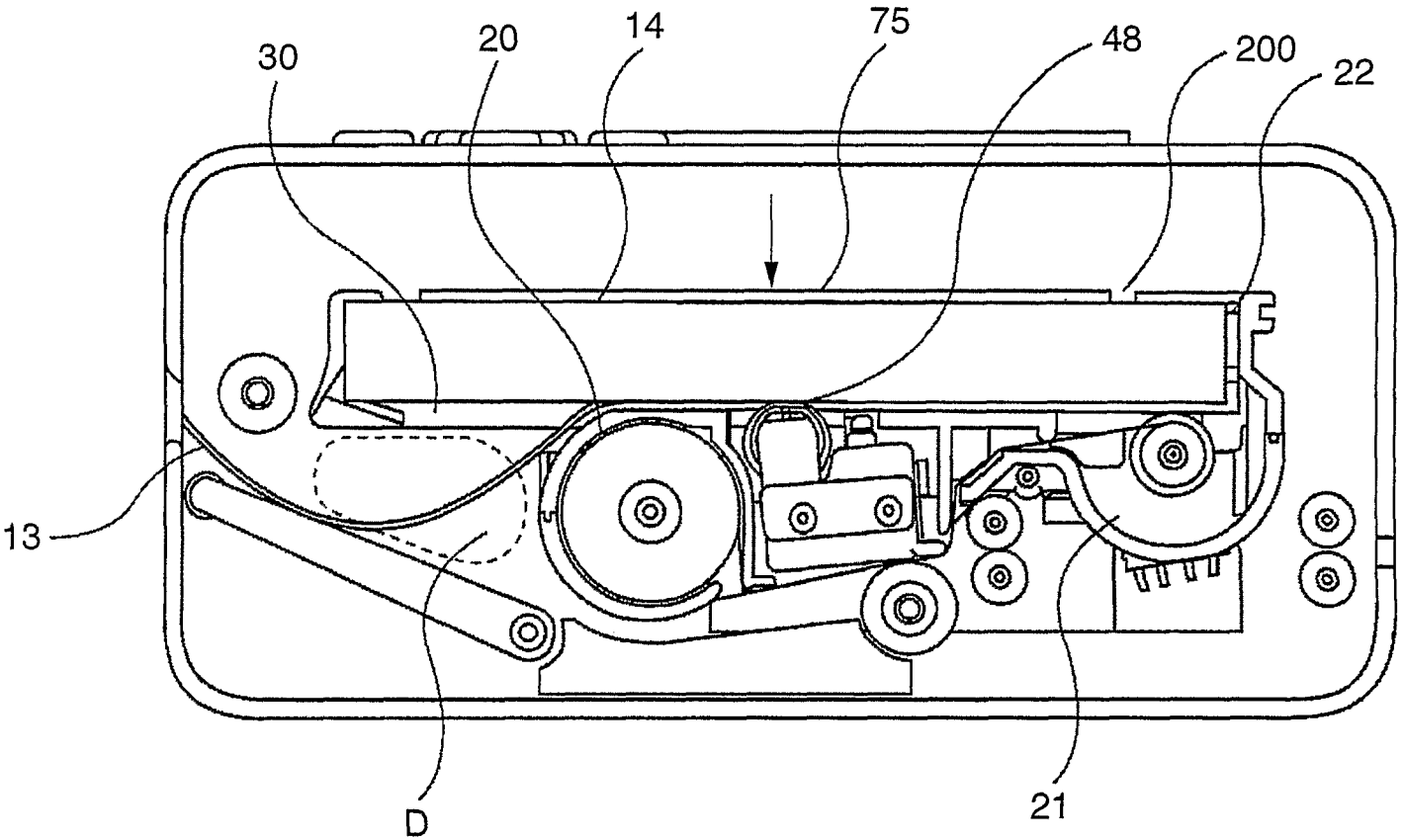
FIG. 22 is another illustration showing the operation of the printer 40.

FIG. 22 shows a state where the ejected recording sheet 13 is drawn from the cassette 1 by a predetermined amount.

As shown in FIG. 22, the recording sheet 13 is ejected from the eject portion 30 to be curved along the supply unit housing 20 of the ink sheet 12. The recording sheet 13 is a photo sheet for thermal transfer printing. If such a sheet is strongly bent, a print surface thereof may be damaged or wrinkled. However, with the printer 40 according to the embodiment of the present invention, the recording sheet 13 may be gently bent in the space D provided adjacent to the ink-sheet supply unit housing 20 and below the eject portion 30 as shown in the drawing. Since the sheet feed roller 48 can substantially drive the center of the recording sheet 13, and hence, a sufficient length of the recording sheet 13 may be bent, thereby enhancing reliability of the separation. Also, the recording sheet 13 will not be strongly bent, thereby minimizing damage to the recording sheet 13. The space D may be secured since the ink-sheet take-up unit housing 21 is arranged along an end of the recording sheet housing 22.

Since the sheet feed roller 48 is disposed at the thermal head unit 45, the printer can be downsized. Also, since the upper opening 200 for mounting and pressing the recording sheets 13 is provided at a side opposite to the thermal head unit 45, the pressure may be applied effectively.

Figure 23:
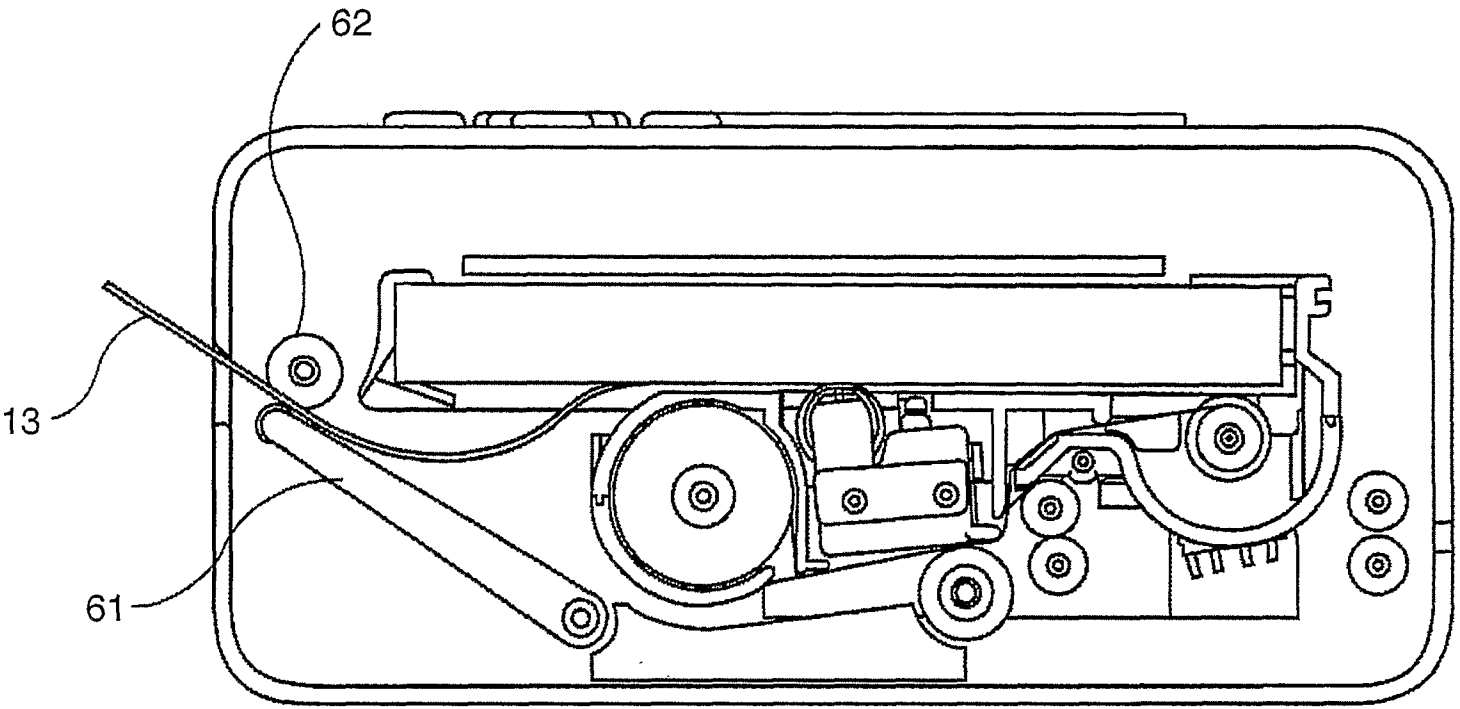
FIG. 23 is yet another illustration showing the operation of the printer 40.
Figure 24:
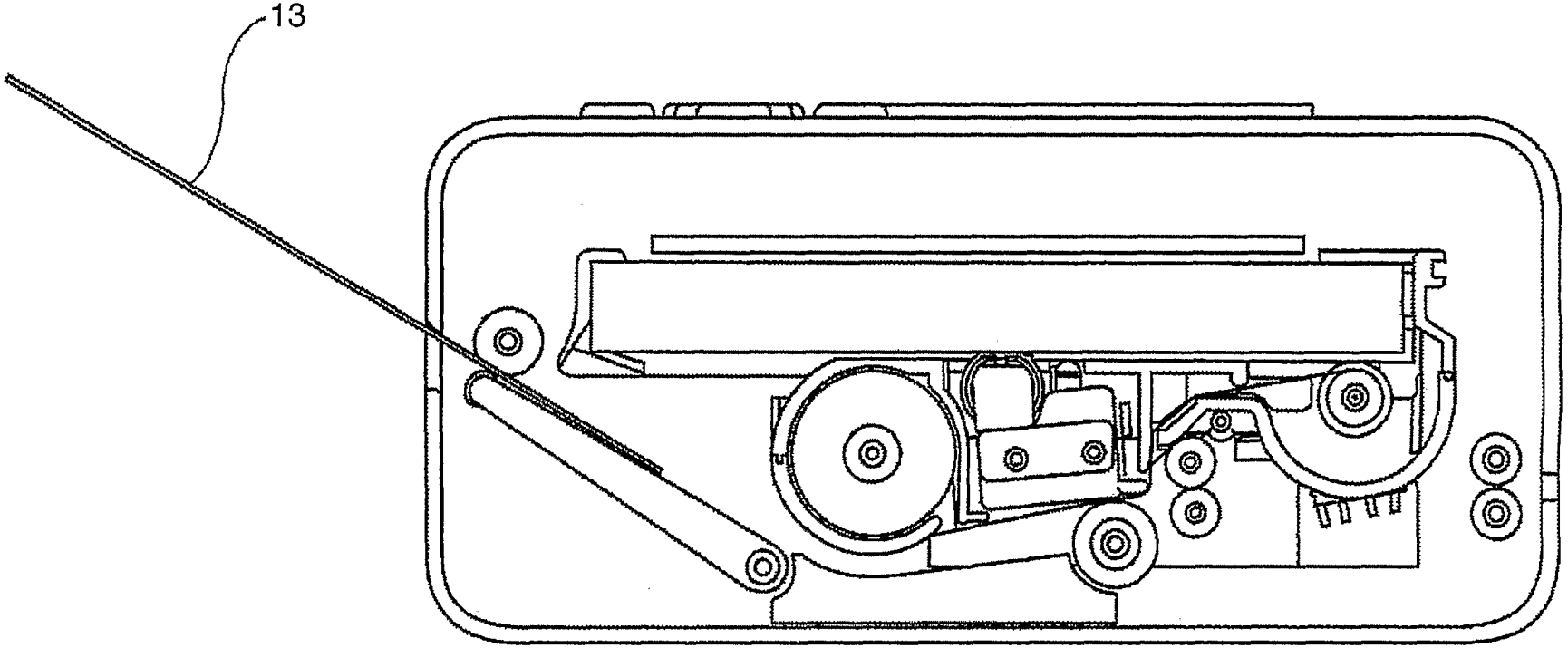
FIG. 24 is a further illustration showing the operation of the printer 40.
Figure 25:
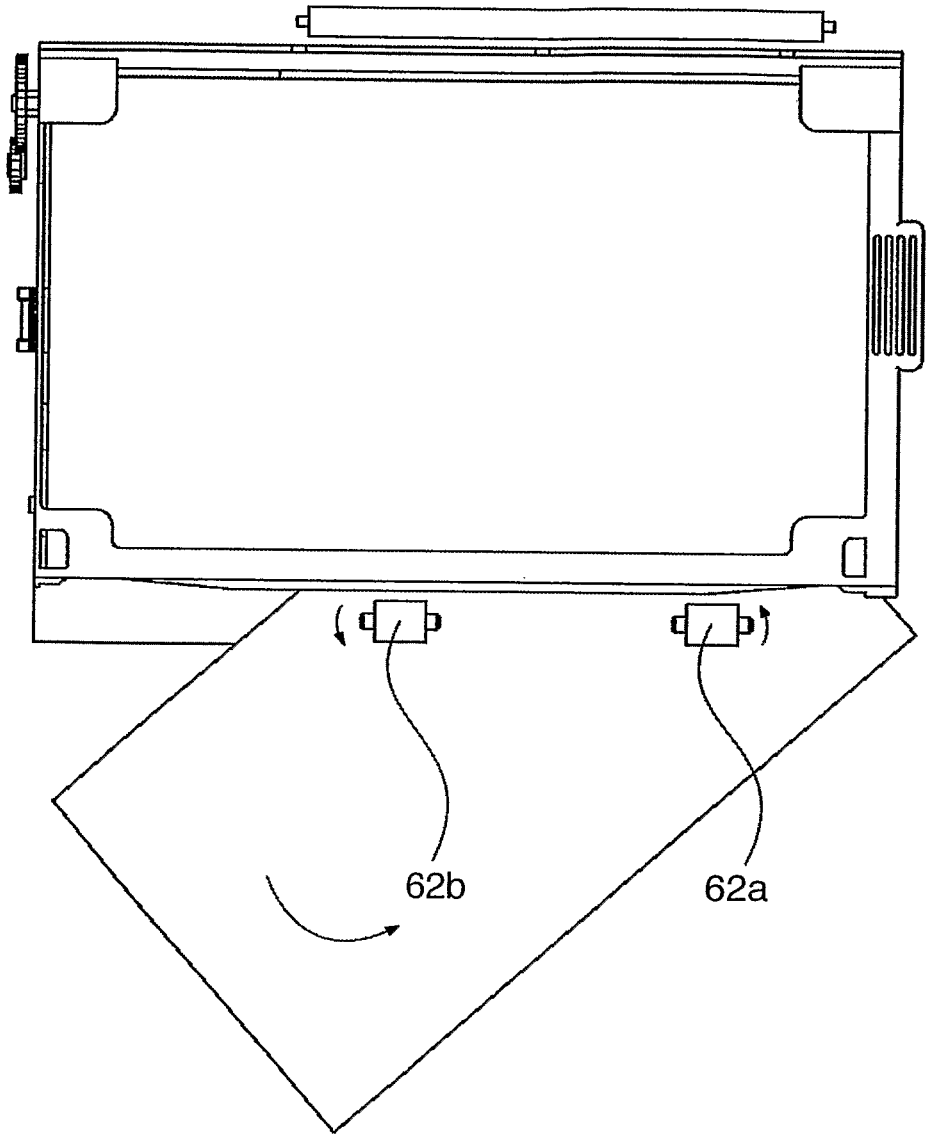
FIG. 25 is a plan view showing the operation of the printer 40.
Figure 26:
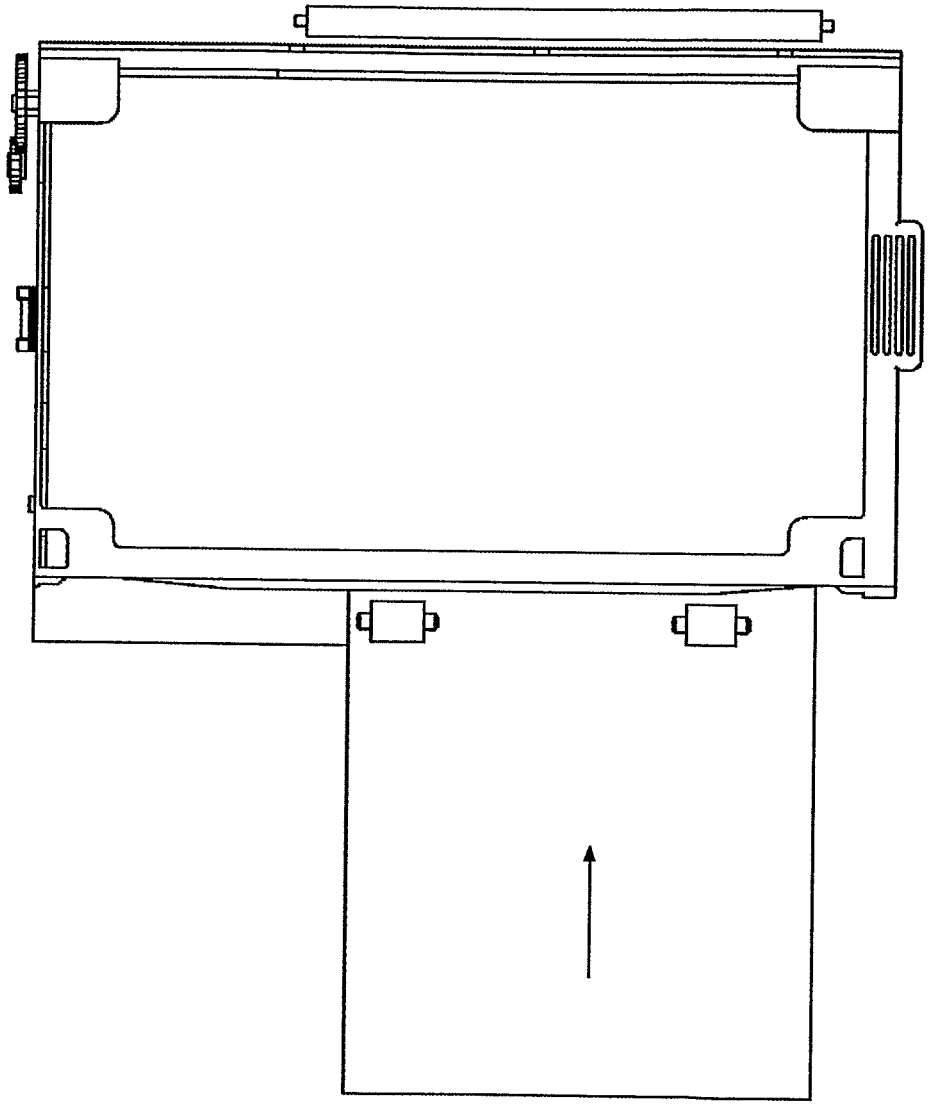
FIG. 26 is another plan view showing the operation of the printer 40.

After the predetermined amount of recording sheet 13 is drawn, a roller plate 61, shown in FIG. 23, presses the recording sheet 13 toward first rollers 62, and the recording sheet 13 is further drawn due to the rotation of the first rollers 62. FIG. 24 shows a state where the recording sheet 13 is completely drawn from the cassette 1, and conveyed by a predetermined amount. In this state, the recording sheet 13 is turned about an axis perpendicular to the surface of the recording sheet 13. FIG. 25 shows the middle of the rotation. The recording sheet 13 is turned by rotating the two first rollers 62 (62*a* and 62*b*) inversely to each other. A first roller 62*a* is rotated such that the recording sheet 13 is retracted to the printer 40, and a first roller 62*b* is rotated such that the recording sheet 13 is advanced to the outside of the printer 40. FIG. 26 shows a state where the rotation is completed. In this state, the recording sheet 13 is conveyed to the inside of the printer 40 and the operation shifts to the printing operation.

Since the roller plate 61, and the first rollers 61*a* and 62*b*, used for the conveyance of the recording sheet 13, are appropriately arranged in the space D defined by disposing the ink-sheet take-up unit housing 21 at the right side in the drawing and along the recording sheet housing 22, the printer 40 can be reduced in size. Also, since the eject portion 30 is provided outside the ink-sheet supply unit housing 20 which is upstream in a conveyance path in printing, the recording sheet 13 may be conveyed smoothly in printing.

As described above, in this embodiment, the eject portion 30 is provided at the surface of the recording sheet housing 22 near the ink-sheet housings, and the ink-sheet supply unit housing 20 is disposed between the ink-sheet take-up unit housing 21 and the eject portion 30. Since the recording sheet 13 is ejected from the eject portion 30, it may be ejected upstream in the ink-sheet conveyance direction in printing. Accordingly, the printing may be performed by conveying the recording sheet 13 directly to the thermal head 47 without conveying it in a complicated manner. In addition, since the recording sheet 13 is ejected from the surface near the ink-sheet housings, the recording sheet 13 may be ejected in the vicinity of a printing section. Therefore, the printer may be reduced in size.

Figure 27:
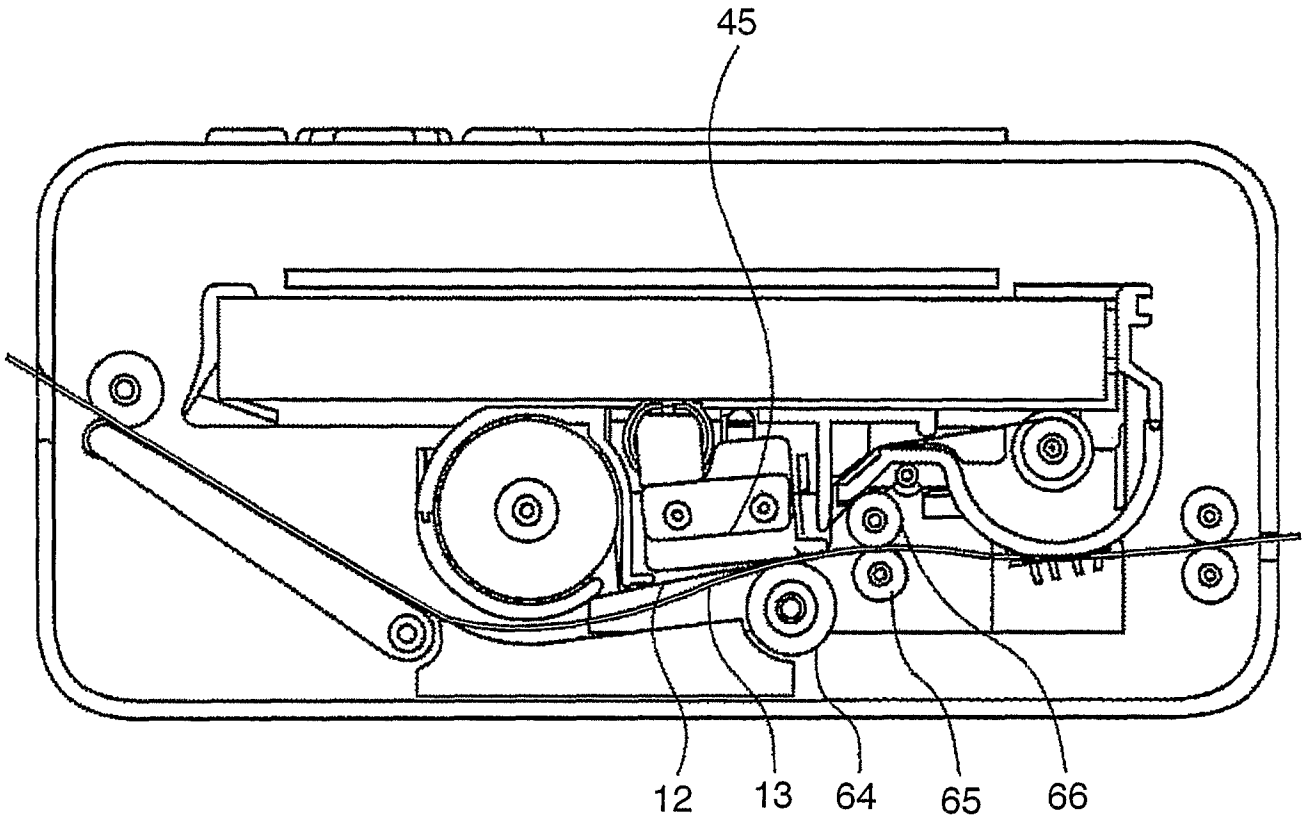
FIG. 27 is an illustration showing the operation of the printer 40.

FIG. 27 shows a printing state. In the printing operation, the thermal head unit 45 and a platen roller 64 press the ink sheet 12 and the recording sheet 13, and the thermal head unit 45 generates heat to thermal-transfer ink applied on the ink sheet 12 to the recording sheet 13. At this time, a capstan roller 65 and a pinch roller 66 pair provided downstream in the printing direction conveys the recording sheet 13. After the first color is printed, the thermal head unit 45 is retracted from the ink sheet 12 to release the pressure, and the capstan roller 65 and the pinch roller 66 are rotated in the direction opposite to the printing direction to return the recording sheet 13 to the print start position. Then, the residual colors are printed sequentially in the same manner as the first color. Thus, full-color printing is performed with the three colors of yellow, magenta and cyan.

When the printing is completed, the recording sheet 13 is ejected downstream in the conveyance path of the printer 40, namely, to the outside. The above-described operation is repeated if the user operates the printing, and the printing is available until the recording sheets 13 and the ink sheet 12 accommodated in the cassette 1 are used up. Since the recording sheets 13 and the ink sheet 12 correspond to the same number of prints, they will both run out at the same time. The printer 40 according to the embodiment of the present invention may detect the absence of the recording sheet 13, and will not perform the printing operation.

Next, a method for detecting the presence or absence of the recording sheet 13 will be described with reference to FIGS. 28A and 28B, and 29. FIG. 28B shows a state where a sufficient amount of recording sheets 13 are left. As shown in FIG. 28B, the photo reflector 53 is disposed to substantially oppose the recording sheets 13. When the printing operation is started, the pressure plate 75 presses the recording sheets 13, and accordingly, the recording sheets 13 are pressed toward the photo reflector 53. The photo reflector 53 emits infrared light, the infrared light is reflected by the back surface of the recording sheet 13, and the photo reflector 53 detects the reflected light. The printer 40 then determines that a recording sheet 13 is present when detecting the reflected light, since a typical recording sheet 13 is white, it has a high reflectivity and is easily detected. In addition, the detection operation is performed only when the pressure plate 75 is located at the pressing position, the distance between the recording sheet 13 and the photo reflector 53 is decreased, and the detection is highly reliable.

Figure 28A:
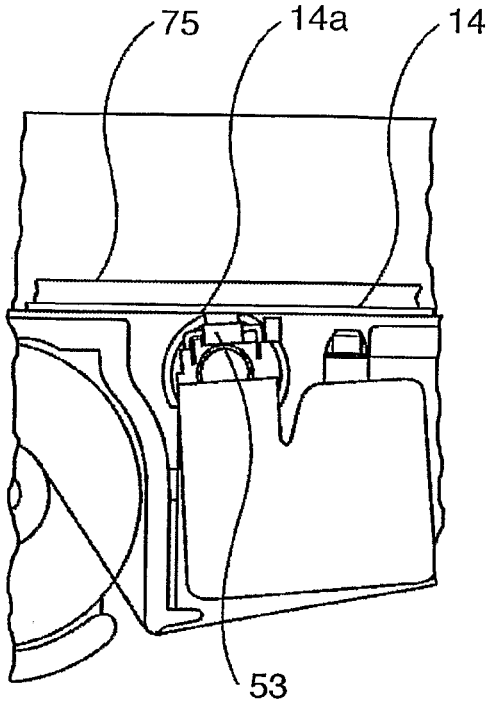
FIGS. 28A and 28B are illustrations each showing a method for detecting the presence of the recording sheet 13.
Figure 28B:
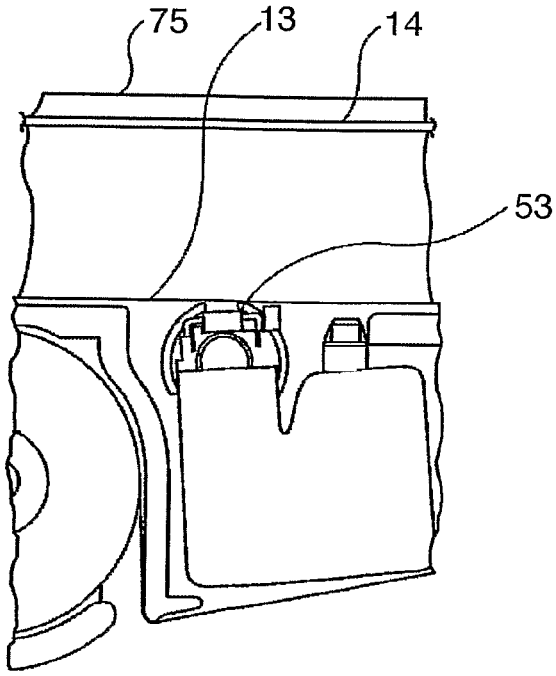
Figure 29:
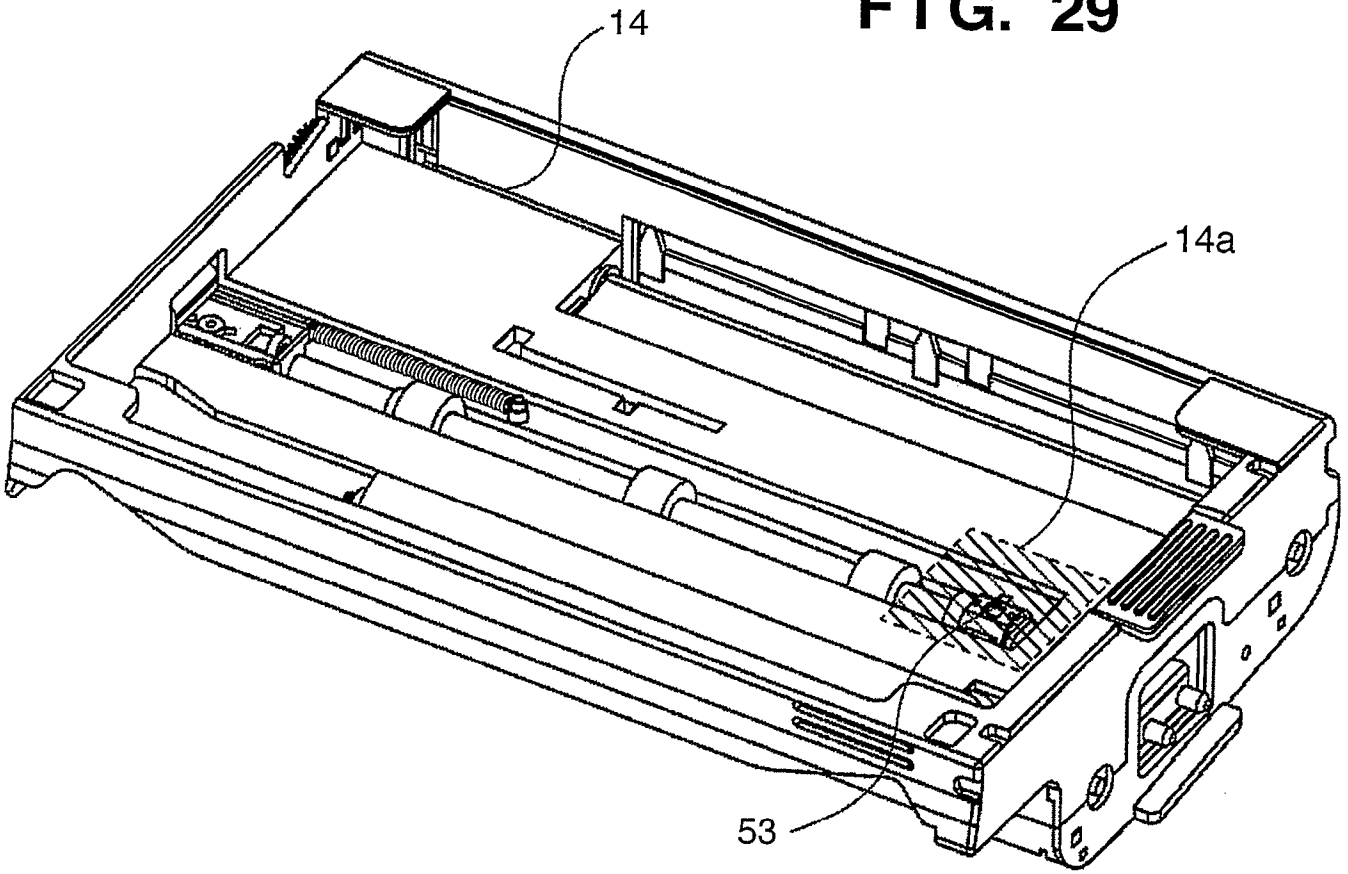
FIG. 29 is a perspective view showing the method for detecting the presence of the recording sheet 13.

FIG. 28A shows a state where the photo reflector 53 detects the absence of the recording sheet 13 when no recording sheet 13 is left, but only the protection sheet 14 is present, and the pressure plate 75 is located at the pressing position. As shown in FIG. 29, ink, e.g., black print 14*a* with a low reflectivity of infrared light, is applied at a portion of the protection sheet 14 opposing the photo reflector 53. Because of this, the photo reflector 53 detects no reflected light, thereby determining the absence of the recording sheet 13. While printed ink having low reflectivity is used in this embodiment, a hole may alternatively be provided at a position opposing the photo reflector 53. Even in such a case, the detection for the absence of the recording sheet 13 may be attained because the photo reflector 53 may detect no reflected light.

Figure 30:
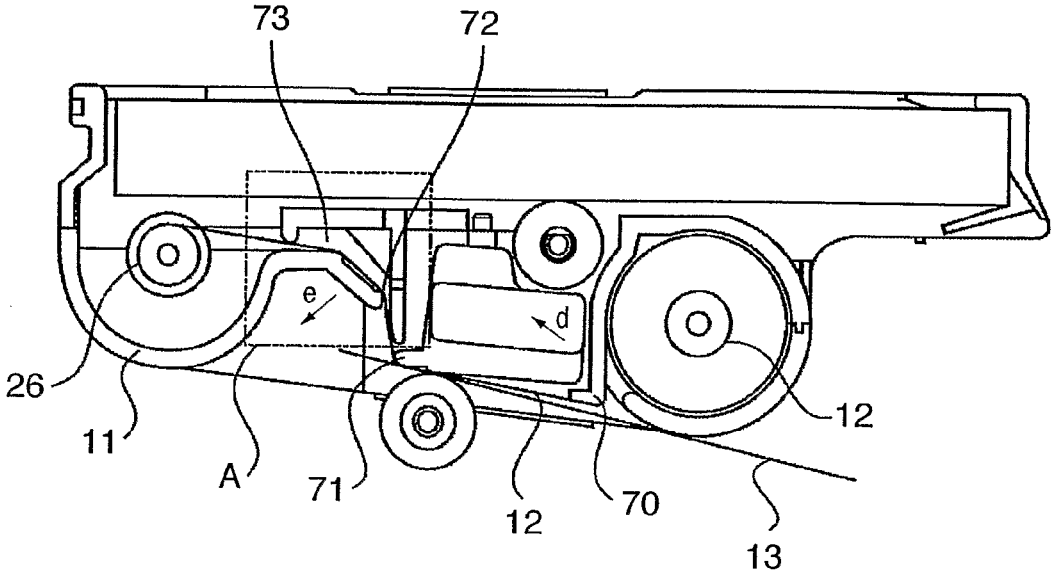
FIG. 30 is an illustration showing conveyance of an ink sheet 12.
Figure 31:
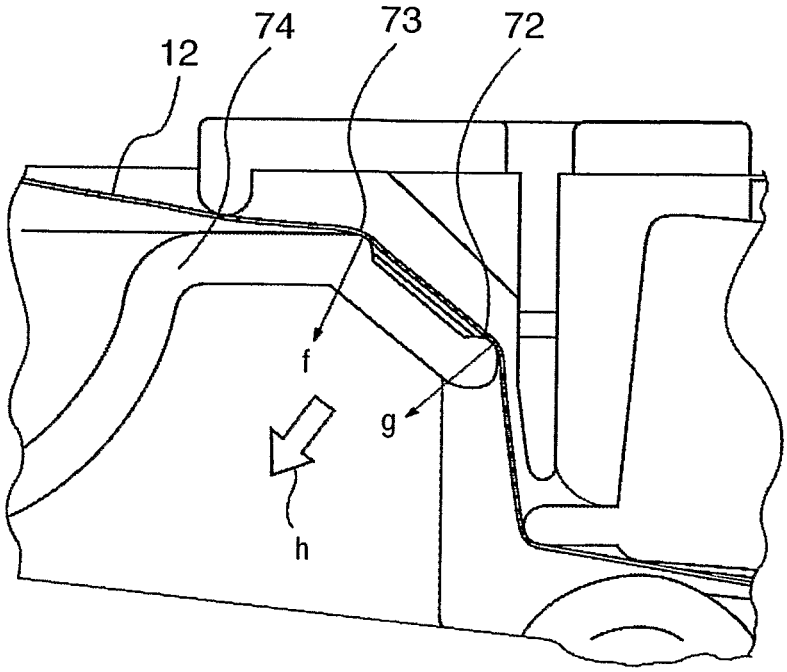
FIG. 31 is a more detailed illustration showing the conveyance of the ink sheet 12.
Figure 32A:
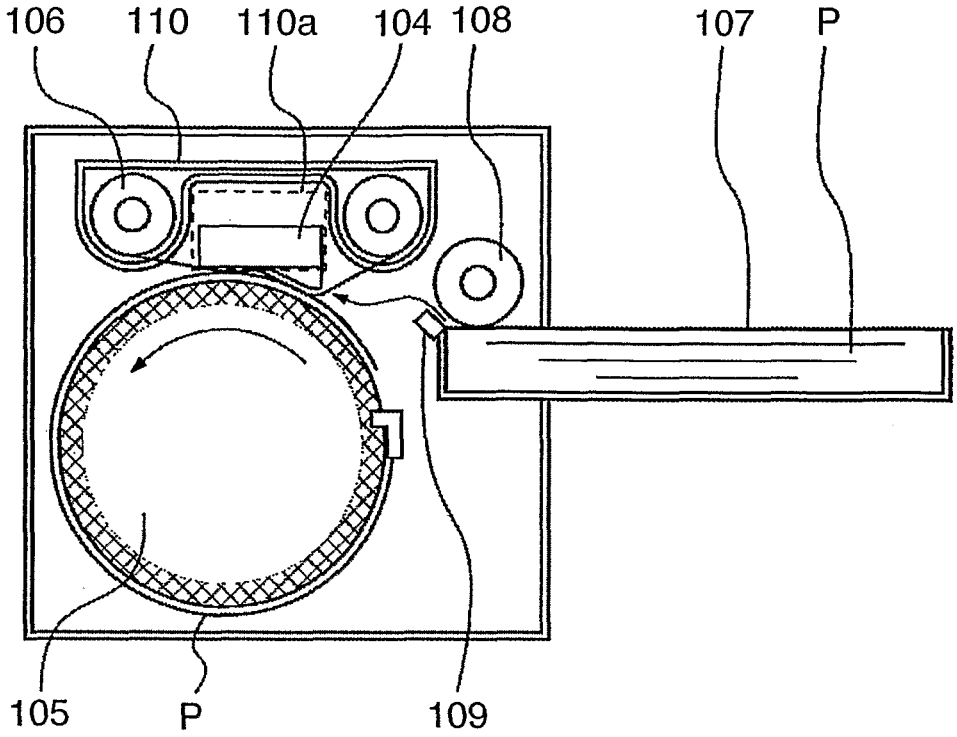
FIGS. 32A and 32B are illustrations each showing a first exemplary configuration of a thermal transfer printer of the related art.
Figure 32B:
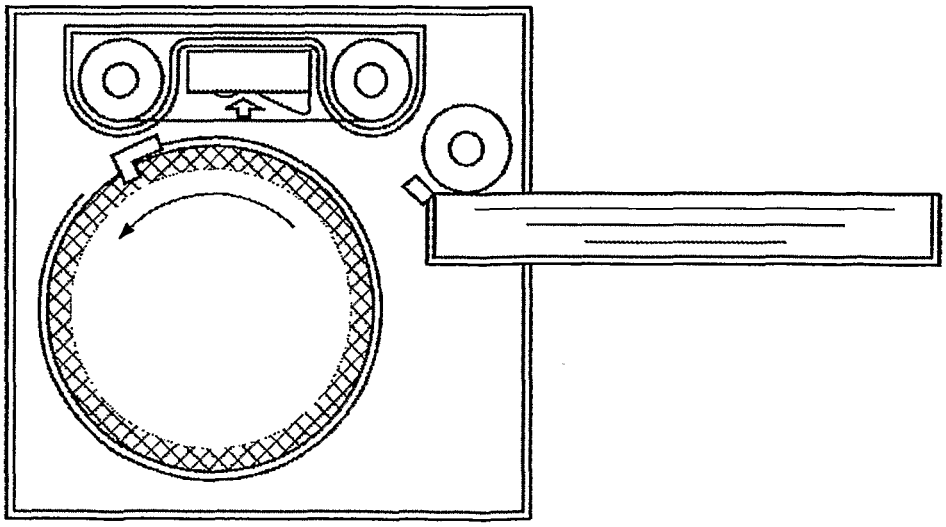
Figure 33A:
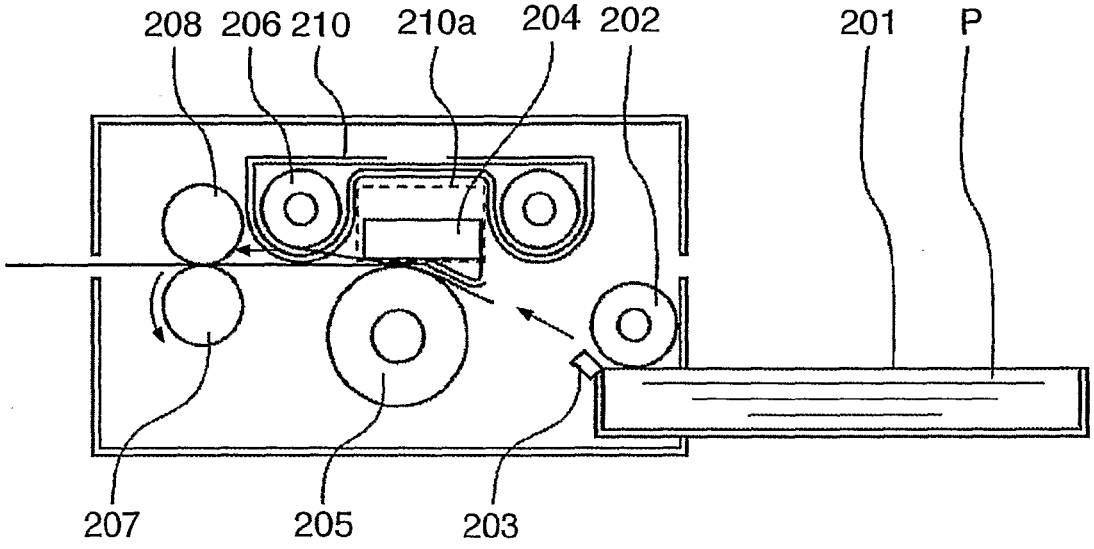
FIGS. 33A and 33B are illustrations each showing a second exemplary configuration of a thermal transfer printer of the related art.
Figure 33B:
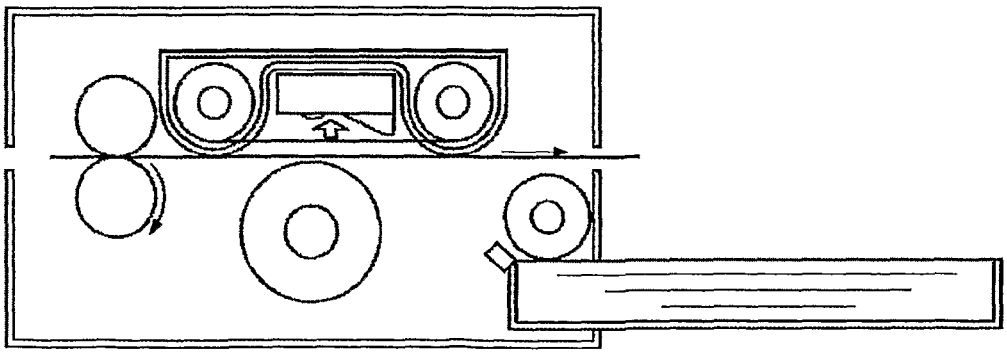
Figure 34:
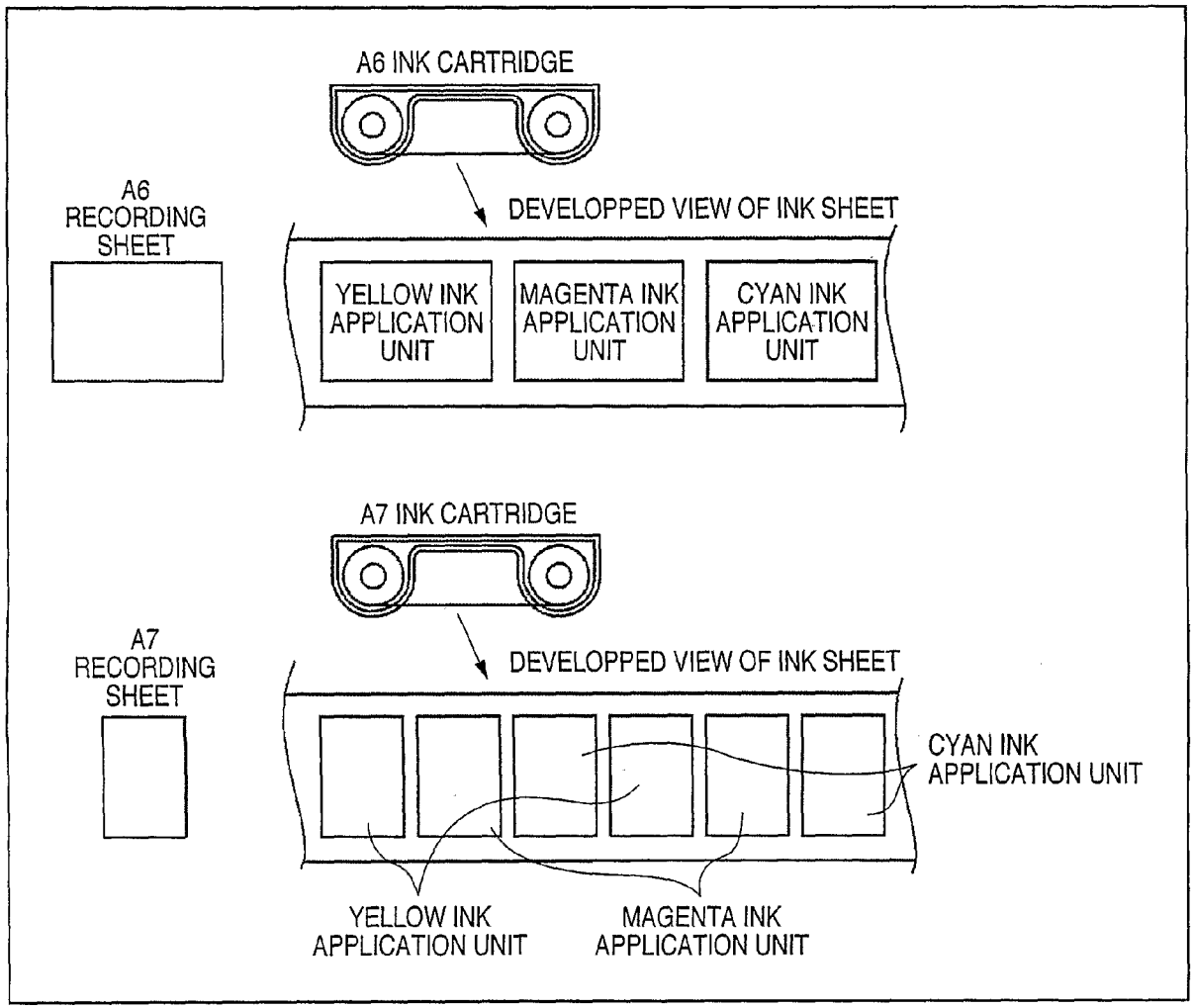
FIG. 34 is a developed view showing an ink sheet.

Next, conveyance of the ink sheet 12 during printing will be described. FIG. 30 shows a conveyance path of the ink sheet 12 in printing when viewed from the main body of the printer 40. The conveyance path is of the ink sheet 12 extending from a portion where the ink sheet 12 is wound around the first bobbin 12*a* on the right hand side of the figure, to a portion where the ink sheet 12 is taken up by the second bobbin 12*b* on the left hand side of the figure. The conveyance path is defined by guiding members (first to third guides) 70, 72, and 73, a separation plate 71, and the like, provided at the upper and lower cases 10 and 11, for guiding the conveyance of the ink sheet 12. First, the ink sheet 12 wound around the first bobbin 12*a* is turned toward the thermal head 47 by the first guide 70. After the printing is performed by the thermal head 47, the ink sheet 12 is separated from the recording sheet 13 by the separation plate 71, and then turned by the second and third guides 72 and 73 provided at the lower case 11, and taken up by the second bobbin 12*b*. Since it is necessary for the ink sheet 12 to have a predetermined tension in printing, a predetermined torque is applied to the first bobbin 12*a* by a friction spring or the like. In addition, a tension is applied to the ink sheet 12 when it is separated from the recording sheet 13 by the separation plate 71. Accordingly, a load is applied to the upper case 10 in a direction indicated by the arrow d, while a load is applied to the lower case 11 in a direction indicated by the arrow e. Such loads cause torsion loads against the upper and lower cases 10 and 11 as moments about the first and second bobbins 12*a* and 12*b*. The upper and lower cases 10 and 11 are made of plastic by injection molding as described above, and moreover, the upper case 10 has the eject portion 30 for ejecting the recording sheet 13, and the opening 34 for the sheet feed roller 48 and the photo reflector 53. Accordingly, the vicinity of the supply unit housing 20 provided near the opening 34 and the eject portion 30 especially has a low rigidity, thereby being easily deformable. Also, even in the vicinity of the take-up unit housing 21, the second and third guides 72 and 73 provided at the lower case 11 receive large loads caused by the above-described tensions and the torque applied when the ink sheet 12 is taken up. FIG. 31 shows the details of the part A in FIG. 30. As shown in FIG. 31, the second and third guides 72 and 73 receive loads in directions indicated by the arrows g and f, and hence, a force in a direction indicated by the arrow h acts on the vicinity of the second and third guides 72 and 73 so as to be bent from a portion 74 of the lower case 11. The guiding members 70, 72, and 73 coming into contact with the ink sheet 12 between the first and second bobbins 12*a* and 12*b* receive the large loads, and are easily deformable.

If the upper and lower cases 10 and 11 deform, the conveyance path of the ink sheet 12 is distorted, and the ink sheet 12 may not be smoothly conveyed in the path. The failure in smooth conveyance may cause meandering or wrinkling of the ink sheet 12 when it is taken up by the second bobbin 12*b*. As the wrinkle spreads to the printing path, the wrinkle may appear in the printed image, which may be a serious problem for the printer 40. Owing to this, it is extremely important to stabilize the conveyance path of the ink sheet 12.

With the printer 40 according to the embodiment of the present invention, when the cassette 1 is inserted, the thermal head unit 45 is installed to the space provided between the ink sheet 12 and the recording sheet 13 in the housing 22 between the ink-sheet supply unit housing 20 (first ink-sheet housing) and the ink-sheet take-up unit housing 21 (second ink-sheet housing). The thermal head unit 45 has the sheet feed roller 48 for driving the ejection of the recording sheet 13. The thermal head 47 and the sheet feed roller 48 are disposed in the space as the thermal head unit 45, and the opening 34 for driving the ejection of the recording sheet 13 from the recording sheet housing 22 is provided at the surface of housing 22 of the integrated ink-and-paper cassette 1, between the supply unit housing 20 (first ink-sheet housing) and the take-up unit housing 21 (second ink-sheet housing). Accordingly, it is not necessary to separately provide spaces for the thermal head 47 and the sheet feed roller 48, and hence, the printer 40 may be downsized.

In the printer 40 according to the embodiment of the present invention, the sheet feed roller 48 is disposed between the supply unit housing 20 and the take-up unit housing 21, but not at the outside of the ink-sheet housings. Accordingly, there is provided a sufficient space for bending the recording sheet 13 toward the outside of the ink-sheet housings for feeding the recording sheet 13.

As mentioned before, the cassette 1 according to the embodiment of the present invention has first and second fitting holes 35 and 36 at upper and lower cases 10 and 11. Accordingly, when the cassette 1 is mounted to the printer 40 and the first and second fitting holes 35 and 36 fit with the first and second fitting shafts 56 and 57, the conveyance path of the ink sheet 12 may be stabilized without being deformed due to the torsion loads.

Such first and second fitting holes (fitting units) 35 and 36 may be provided in any portions of the upper and lower cases 10 and 11. However, the conveyance path of the ink sheet 12 may be further stabilized if the fitting units are provided at the inner side of the first and second bobbins 12*a* and 12*b*, as well as in the vicinity of the conveyance path of the ink sheet 12.

In the above-described embodiment, the first fitting hole 35 is provided in the upper case 10 for the ink-sheet supply unit housing 20, whereas the second fitting hole 36 is provided in the lower case 11 for the ink-sheet take-up unit housing 21. By providing the first and second fitting holes 35 and 36 respectively at the upper and lower cases 10 and 11, both cases 10 and 11 may be stabilized. In particular, by providing the first fitting hole 35 at the lower case 11 for the ink-sheet supply unit housing 20, the rigidity of which is extremely low since the two openings are provided, the portion with the low rigidity and which is easily deformable may be reinforced. Further, by providing the first and second fitting holes 35 and 36 near the positions receiving the tensions due to the conveyance of the ink sheet 12 and the loads due to the taking up of the ink sheet 12, the loads may be reduced, and the moments act on the upper and lower cases 10 and 11 may be reduced, thereby effectively avoiding deformation. While the first and second fitting holes 35 and 36 are provided at the cassette 1 and the first and second fitting shafts 56 and 57 are provided at the printer 40 in the above-described embodiment, fitting shafts may be provided at a cassette and fitting holes may be provided at a printer.

In addition, the first and second fitting holes 35 and 36 fitted with the printer 40 are provided at a frame for the ink-sheet housings near the conveyance path of the ink sheet 12, the frame being easily deformable since it receives the tensions due to the conveyance of the ink sheet 12 and the loads due to the taking up of the ink sheet 12. Accordingly, the loads may be reduced, thereby avoiding the deformation of the frame due to the loads.

Therefore, the conveyance path of the ink sheet 12 may be prevented from being distorted by maintaining the rigidity of the cassette 1 and reducing the loads for the cassette 1, thereby stabilizing the conveyance path of the ink sheet 12.

In addition, the weld shaft 80 provided at the upper case 10 and the weld hole 81 provided at the lower case 11 are coupled together by heat welding. Accordingly, the rigidity of the cassette 1 may be further enhanced by further firmly integrating the vicinity of the second and third guides 72 and 73 of the lower case 11 with the upper case 10, so that the two casings are prevented from being detached from each other even when the cassette 1 receives an impact or vibration in printing.

In addition, since the weld shaft 80 and the weld hole 81 are provided near the conveyance path of the ink sheet 12, the portion likely receiving the loads due to the tensions of the ink sheet 12 and the moments due to the taking up of the ink sheet 12, the upper and lower cases 10 and 11 may be prevented from being deformed or detached from each other due to the loads, thereby further stabilizing the conveyance path of the ink sheet 12. In the case of the above-described embodiment, the way of providing the weld shaft 80 and the weld hole 81 is particularly effective since the upper and lower cases 10 and 11 are coupled together by the coupling using the pawls (10*a*, 11*a*) and holes (10*b*, 11*b*) utilizing elastic deformation of the resin material because the coupling may be released due to the loads.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2006-042535 filed Feb. 20, 2006, 2006-050590 filed Feb. 27, 2006 and 2006-211050 filed Aug. 2, 2006, which are hereby incorporated by reference herein in their entirety.

The invention claimed is:

1. A printer comprising:

a roller plate;

a set of rollers;

a thermal head unit, comprising:

a sheet ejection mechanism, and a thermal head; and a cassette, comprising:

a first casing defining a recording sheet housing for accommodating recording sheets, a second casing engaging the first casing so as to define a first ink-sheet housing and a second ink-sheet housing, the first ink-sheet housing accommodating a first bobbin around which the ink sheet is wound, the second ink-sheet housing accommodating a second bobbin which takes up the ink sheet drawn from the first bobbin, and a first opening provided on a surface of the first casing, the surface facing the first and second ink-sheet housings, wherein the first ink-sheet housing is disposed between the second ink-sheet housing and the first opening, wherein a space is provided between the first ink-sheet housing and the second ink-sheet housing and between the ink sheet drawn from the first bobbin and the recording sheet housing, and the space is configured to receive the thermal head unit when the cassette is mounted in the printer, wherein the recording sheet housing is configured to accommodate the recording sheets such that a surface of each recording sheet, on which ink is not transferred by the thermal head during a printing operation, faces the first and second ink-sheet housings, and wherein the roller plate and the set of rollers are configured to convey the recording sheet ejected through the first opening of the recording sheet housing to the thermal head in such a manner that the surface of the recording sheet on which ink is not transferred by the thermal head, and which faced the first and second ink-sheet housing when accommodated in the recording sheet housing, faces away from the first and second ink-sheet housings when the recording sheet is transferred to the thermal head.

2. The printer according to claim 1, wherein the cassette further comprises:

a second opening provided on the same surface as the first opening, and through which the sheet ejection mechanism contacts a recording sheet in the recording sheet housing, and a third opening provided on an opposite surface of the first casing from the surface on which first and second openings are provided, and through which the recording sheet which is accommodated in the recording sheet housing.

3. The printer according to claim 2, further comprising:

a drive unit configured to drive the sheet ejecting mechanism to rotate and thereby eject the recording sheet through first opening of the recording sheet housing.

4. The printer according to claim 2, further comprising:

a pressure plate configured to move in a downward direction perpendicular to the surface of the first casing in which the first and second openings are provided, wherein the pressure plate moves in a downward direction through the third opening so as to press the recording sheets accommodated in the recording sheet housing towards the sheet ejection mechanism.

5. The printer according to claim 4, further comprising:

a drive unit configured to drive the sheet ejecting mechanism to rotate and thereby eject the recording sheet through first opening of the recording sheet housing.

* * * * *